US008300076B2

(12) United States Patent
Nomura et al.

(10) Patent No.: US 8,300,076 B2
(45) Date of Patent: Oct. 30, 2012

(54) LINE HEAD AND AN IMAGE FORMING APPARATUS USING SUCH A LINE HEAD

(75) Inventors: Yujiro Nomura, Shiojiri (JP); Nozomu Inoue, Matsumoto (JP); Ryuta Koizumi, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 262 days.

(21) Appl. No.: 12/764,495

(22) Filed: Apr. 21, 2010

(65) Prior Publication Data

US 2010/0201778 A1 Aug. 12, 2010

Related U.S. Application Data

(62) Division of application No. 11/832,525, filed on Aug. 1, 2007, now Pat. No. 7,733,364.

(30) Foreign Application Priority Data

| | | |
|---|---|---|
| Aug. 4, 2006 | (JP) | 2006-213302 |
| Oct. 3, 2006 | (JP) | 2006-271579 |
| May 28, 2007 | (JP) | 2007-139897 |

(51) Int. Cl.
*B41J 15/14* (2006.01)
*B41J 27/00* (2006.01)

(52) U.S. Cl. ..... 347/241; 347/256

(58) Field of Classification Search ..... 347/230, 347/238, 241–244, 256–258, 233
See application file for complete search history.

(56) References Cited

U.S. PATENT DOCUMENTS

| | | | | |
|---|---|---|---|---|
| 5,023,442 | A | 6/1991 | Taniguchi et al. | 250/208.1 |
| 5,444,520 | A | 8/1995 | Murano | 399/221 |
| 5,617,131 | A | 4/1997 | Murano et al. | 347/233 |
| 5,655,189 | A * | 8/1997 | Murano | 399/220 |
| 6,330,017 | B1 | 12/2001 | Suzuki | 347/238 |
| 7,548,251 | B2 | 6/2009 | Terumoto | |

FOREIGN PATENT DOCUMENTS

| | | |
|---|---|---|
| EP | 0 348 003 A2 | 12/1989 |
| JP | 06-297767 | 10/1994 |
| JP | 2510423 | 4/1996 |
| JP | 2000-158705 | 6/2000 |
| JP | 2000158705 A * | 6/2000 |
| JP | 2006021384 A | 1/2006 |

* cited by examiner

*Primary Examiner* — Hai C Pham
(74) *Attorney, Agent, or Firm* — DLA Piper LLP (US)

(57) ABSTRACT

A line head, includes: a substrate which is provided with a plurality of luminous element groups which respectively include a plurality of luminous elements in a first direction which emit light beams; a lens array which includes a plurality of imaging lenses which are provided corresponding to the plurality of luminous element groups; and a light shielding member which is disposed between the substrate and the lens array and includes a plurality of light guiding holes which correspond to the plurality of luminous element groups, wherein the lens array is away from the light shielding member, an inner diameter of each of the plurality of light guiding holes in the first direction is a first light guiding hole diameter, and a bore diameter of each of the plurality of imaging lenses in the first direction is a first lens diameter, and the first light guiding hole diameter is smaller than the first lens diameter.

3 Claims, 24 Drawing Sheets

LINE HEAD AND AN IMAGE FORMING APPARATUS USING SUCH A LINE HEAD

CROSS REFERENCE TO RELATED APPLICATION

This application is a divisional of application Ser. No. 11/832,525, filed on Aug. 1, 2007, the entire contents of which are incorporated herein by reference. The disclosure of Japanese Patent Applications enumerated below including specification, drawings and claims is incorporated herein by reference in its entirety:

No. 2006-213302 filed Aug. 4, 2006;

No. 2006-271579 filed Oct. 3, 2006; and

No. 2007-139897 filed May 28, 2007.

BACKGROUND

1. Technical Field

The present invention relates to a line head which scans a light beam across a surface-to-be-scanned and an image forming apparatus using such a line head.

2. Related Art

Proposed as line heads for scanning a light beam across a surface-to-be-scanned include for instance a line head of an image apparatus described in JP-A-6-297767 which uses luminous element groups (referred to as the "light emitting diode arrays" in this publication) obtained by arranging plural LEDs (light emitting diodes), which are luminous elements, on a base plate which is a substrate.

In the image apparatus described in JP-A-6-297767, a resin lens plate which includes a plurality of imaging lenses such that each imaging lens corresponds to each one of the plural luminous element groups is opposed via a spacer to the luminous element groups. The linear expansion coefficients of the base plate, the lens plate and the spacer are within the range of −2 through $3\times10^{-6}$/° C. at a temperature ranging between −30° C. and 100° C., which suppresses displacement due to a temperature change of the base plate, the lens plate and the spacer relative to each other.

Meanwhile, Japanese Patent No. 2510423 discloses a structure that light shielding plates and the like which are light shielding members surround a space between LED array chip and the imaging lenses like a box to thereby discourage "crosstalk", the phenomenon that light from the LED array chip leaks to the neighboring space or to the outside and deteriorates the printing quality.

To be more specific, plural light guiding holes are formed in the light shielding parts such that each light guiding hole corresponds to each one of the plural luminous element groups. The light guiding holes extend from the associated luminous element groups toward the imaging lenses which correspond to the luminous element groups. Light beams emitted from the luminous element groups, passing through the light guiding holes to which the luminous element groups correspond, impinge upon the imaging lenses which correspond to the luminous element groups. In other words, of the light beams emitted from the luminous element groups, only those passing through the light guiding holes are incident upon the imaging lenses which correspond to the luminous element groups. The light beams impinging upon the imaging lenses are imaged on a surface-to-be-scanned, whereby spots are formed on the surface-to-be-scanned.

Also proposed as a line head of this type is a line head which uses luminous element groups (referred to as the "luminous element arrays" in this publication) obtained by arranging plural luminous elements as described in JP-A-2000-158705 for example. In the line head according to this publication, the plural luminous element groups are arranged side by side and plural imaging lenses are disposed so that they are opposed to the plural luminous element groups on the one-to-one correspondence. Light beams emitted from the luminous elements of the luminous element groups are imaged by the imaging lenses which are opposed to the plural luminous element groups, whereby spots are formed on a surface-to-be-scanned.

SUMMARY

By the way, in the event that a line head uses light shielding plates and the like which are light shielding parts in an effort to suppress crosstalk, if a lens plate and the light shielding plates and the like are bonded to each other at their entire surfaces, owing to a difference between the light shielding plates and the like and the lens plate in terms of thermal expansion and contraction, a temperature change if any will give rise to bending. The bending will result in deviation from positions at which spots are supposed to be formed.

In short, bonding of the light shielding part and the lens plate which serves as a lens array at their entire surfaces during fabrication of such a line head as that described above could give rise to a problem that the line head bends due to a temperature change. That is, a temperature change could make the light shielding part and the lens array expand or contract differently from each other because of the different linear expansion coefficient of the light shielding part and the lens array, and such a difference in thermal expansion and contraction is particularly remarkable in the longitudinal direction of the line head. As a result, the line head may get bent in some instances. The bending causes deviation from spot forming positions.

On the other hand, in the event that the light shielding plates and the like and the lens plate are not bonded to each other at their entire surfaces, owing to a difference between the light shielding plates and the like and the lens plate in terms of thermal expansion and contraction, a temperature change if any will dislocate the imaging lenses and the corresponding light shielding plates and the like from where they are supposed to be positioned relative to each other, thereby leading to a problem that light beams emitted from the luminous elements fall upon other positions than the corresponding imaging lenses, what is called a ghost is generated, and therefore, favorable spots are not obtained. This problem intensifies particularly when glass is used as the substrate of the lens plate and metal, resin or the like is used for the light shielding members. Further, an image formed by an image forming apparatus using such a line head deteriorates.

In other words, even where the light shielding part and the lens array are not bonded to each other at their entire surfaces, due to a difference between the light shielding part and the lens array in terms of thermal expansion and contraction caused by a temperature change, a temperature change if any could dislocate the imaging lenses and the light guiding holes corresponding to the imaging lenses from where they are supposed to be positioned to each other. Because of thus shifted relative positions, light beams emitted from the luminous element groups could impinge upon positions which are off the imaging lenses corresponding to the luminous element groups. The consequence is a problem that a ghost, so called, may be generated and favorable spots may not be obtained. Formation of such undesirable spots is likely to occur particularly when the material of the substrate of the lens array is glass and that of the light shielding part is metal, carbon steel, etc. This is because the linear expansion coefficient of glass is smaller than those of metal, carbon steel and the like, and hence, a difference of the linear expansion coefficients between the lens array and the light shielding part increases.

Further, in a line head as that described above, stop parts may be disposed for the purpose of adjusting the amount of light beams contributing to formation of spots for instance or for other purposes. That is, the stop parts are disposed between the luminous element groups and the imaging lenses so that it is possible to adjust the amount of the light beams incident upon the imaging lenses. Specifically, the stop parts have stop apertures. Of the light beams emitted from the luminous element groups, those passing through the stop apertures can impinge upon the imaging lenses. In the case of the line head above comprising the light shielding part, it is possible to dispose the stop parts inside the light guiding holes which are formed in the light shielding part.

However, due to a difference of the linear expansion coefficients between the substrate which is provided with the luminous element groups and the light shielding part, a temperature change could make the substrate and the light shielding part expand or contract differently from each other, and the tendency is that such a difference in terms of thermal expansion and contraction increases in the longitudinal direction of the line head. Further, because of the difference in terms of thermal expansion and contraction, the luminous element groups and the stop apertures of the light shielding part may get dislocated from where they are supposed to be positioned to each other. As a result, light beams which are not intended to pass through the spot apertures could pass through the spot apertures and become stray light. When thus generated stray light impinges upon the imaging lenses, what are called ghosts could be generated and favorable spots could not be formed, thereby forming defective spots. Those light beams passing through the spot apertures which are not supposed to pass through the spot apertures will be referred to as "stray light" in this specification.

An advantage of some aspects of the invention is that it is possible to suppress generation of ghosts and to form favorable spots even despite a difference in terms of thermal expansion and contraction between a light shielding part and a lens array due to a temperature change.

An advantage of other aspects of the invention is that it is possible to suppress generation of ghosts and to form favorable spots even despite a difference in terms of thermal expansion and contraction between a substrate and a light shielding part due to a temperature change.

Further, as the discussion above indicates, it is desirable that light beams emitted from luminous elements of luminous element groups impinge only upon opposed imaging lenses in a line head as that described above. However, in such a line head, since the plural luminous element groups are disposed side by side and the plural imaging lenses are disposed so that they are opposed to the plural luminous element groups on the one-to-one correspondence, what is called crosstalk could occur. That is, a light beam emitted from a certain luminous element could impinge also upon an adjacent imaging lens to a imaging lens which is opposed to this luminous element. This could result in a problem that it is not possible to form favorable spots.

An advantage of still other aspects of the invention is that it is possible to suppress crosstalk and to form favorable spots in a line head in which plural luminous element groups are disposed side by side and plural imaging lenses are disposed so that they are opposed to the plural luminous element groups on the one-to-one correspondence.

According to a first aspect of the invention, there is provided a line head, comprising: a substrate which is provided with a plurality of luminous element groups which respectively include a plurality of luminous elements in a first direction which emit light beams; a lens array which includes a plurality of imaging lenses which are provided corresponding to the plurality of luminous element groups; and a light shielding member which is disposed between the substrate and the lens array and includes a plurality of light guiding holes which correspond to the plurality of luminous element groups, wherein the lens array is away from the light shielding member, an inner diameter of each of the plurality of light guiding holes in the first direction is a first light guiding hole diameter (Ds), and a bore diameter of each of the plurality of imaging lenses in the first direction is a first lens diameter (D1), and the first light guiding hole diameter (Ds) is smaller than the first lens diameter (D1).

According to a second aspect of the invention, there is provided an image forming apparatus, comprising: a latent image carrier; a substrate which is provided with a plurality of luminous element groups which respectively include a plurality of luminous elements in a first direction which emit light beams; a lens array which includes a plurality of imaging lenses which are provided corresponding to the plurality of luminous element groups; and a light shielding member which is disposed between the substrate and the lens array and includes a plurality of light guiding holes which correspond to the plurality of luminous element groups, wherein the lens array is away from the light shielding member, an inner diameter of each of the plurality of light guiding holes in the first direction is a first light guiding hole diameter (Ds), and a bore diameter of each of the plurality of imaging lenses in the first direction is a first lens diameter (D1), and the first light guiding hole diameter (Ds) is smaller than the first lens diameter (D1).

According to a third aspect of the invention, there is provided a line head, comprising: a substrate which transmits a light beam; a luminous element group which includes a plurality of luminous elements which are on the substrate; an imaging lens which is provided corresponding to the luminous element group; and a light shielding member which is disposed so that its one surface is opposed to a surface of the substrate, the surface being different from the surface on which the luminous element group is provided, and that its other surface is opposed to the imaging lens, and which includes a light guiding hole corresponding to the luminous element group, wherein a thickness of the substrate and an index of refraction of the substrate are set so that a light beam emitted from an outer-most element, which is a luminous element which is one of the luminous elements belonging to the luminous element group and which is located at the shortest distance to a neighboring aperture in the one surface of the light guiding hole which corresponds to a next luminous element group which is next to the luminous element group, toward the neighboring aperture is totally reflected by the surface, which is opposed to the light shielding member, of the substrate.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

First Embodiment

Figure 1:
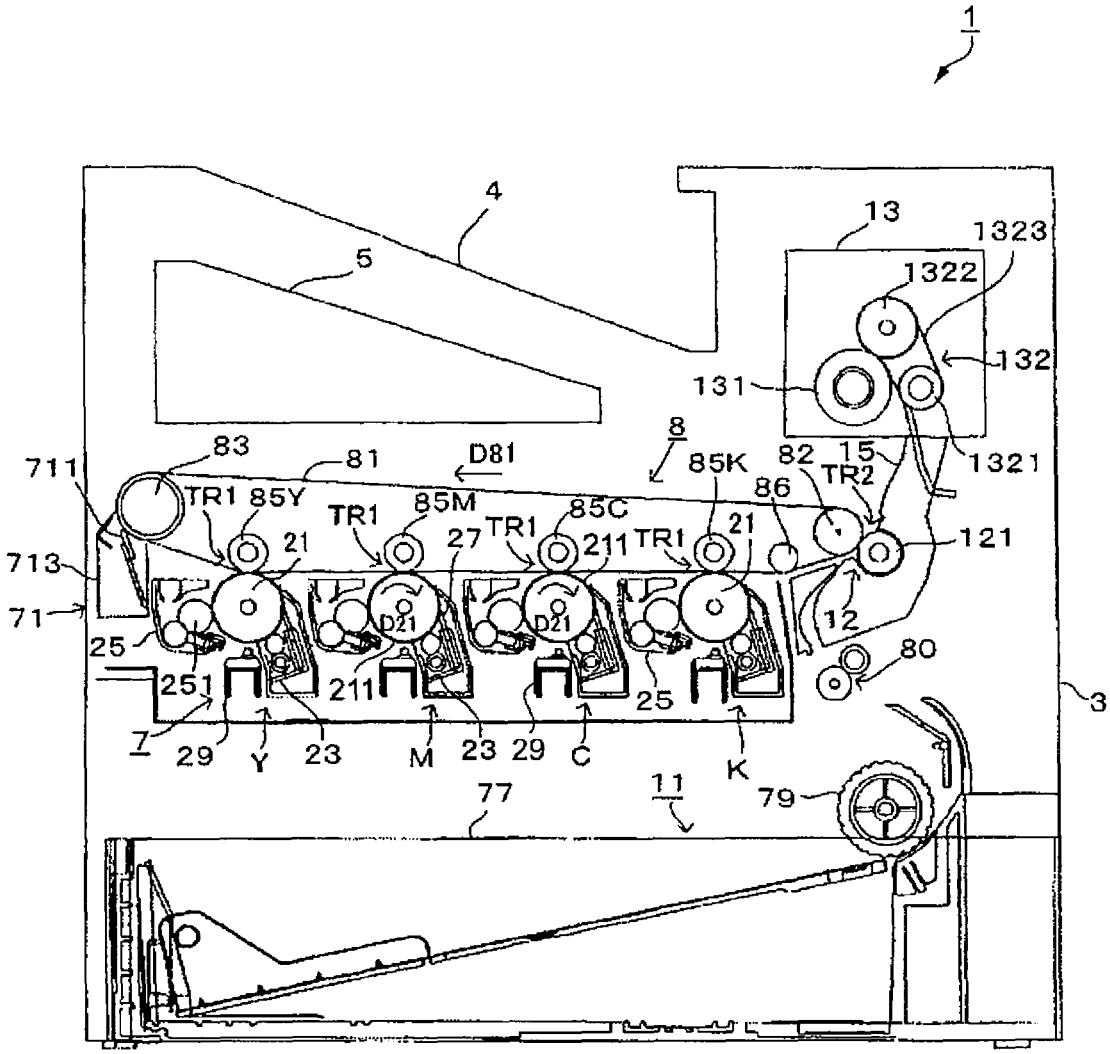
FIG. 1 is a diagram showing an embodiment of an image forming apparatus according to the invention.
Figure 2:
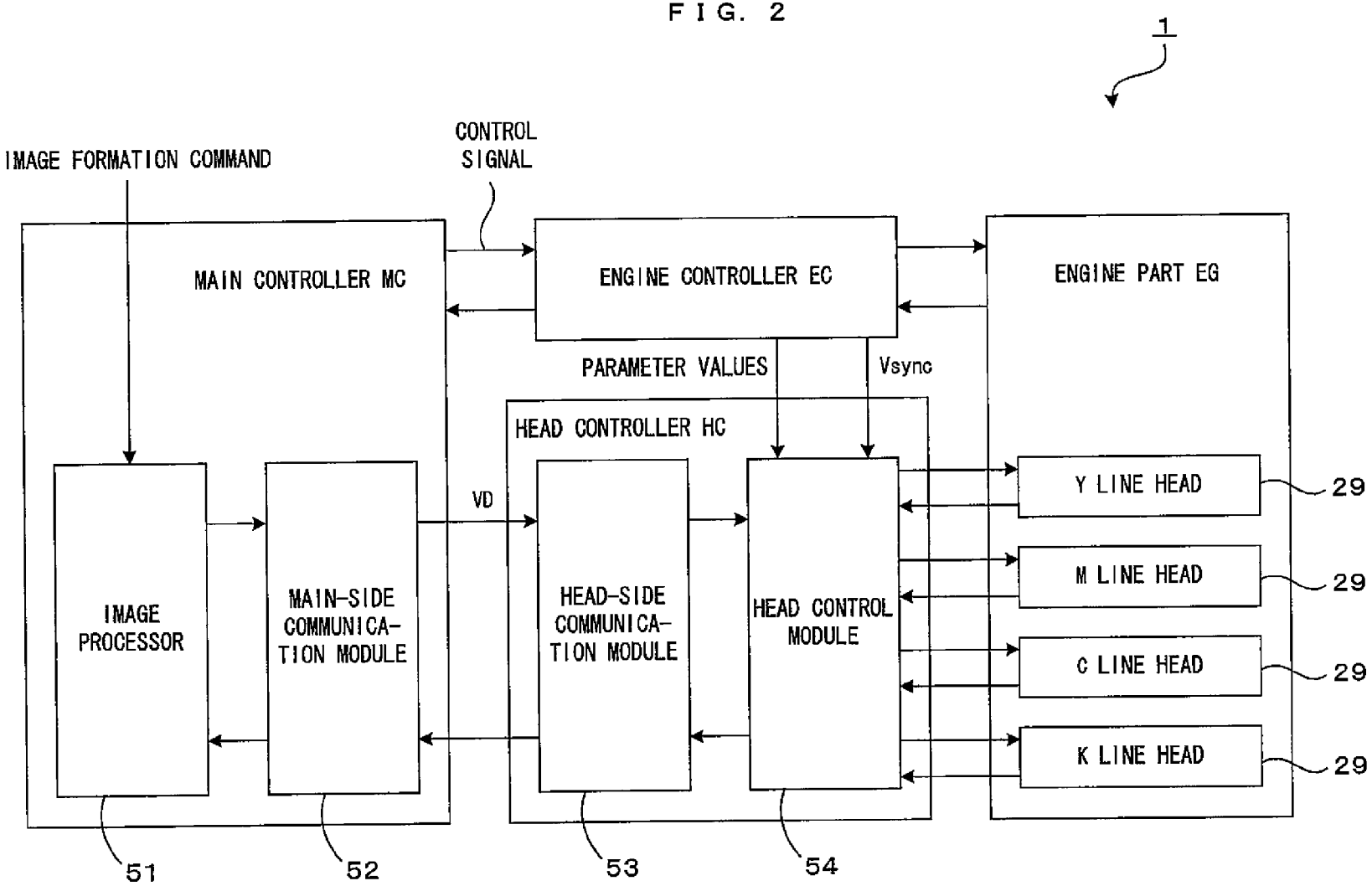
FIG. 2 is a diagram showing an electrical construction of the image forming apparatus of FIG. 1 and the line head.

FIG. 1 is a diagram showing an embodiment of an image forming apparatus and a line head as an exposure unit. FIG. 2 is a diagram showing an electrical construction of the image forming apparatus of FIG. 1 and the line head.

The image forming apparatus 1 can selectively execute a color mode for forming a color image by superimposing four color toners of black (K), cyan (C), magenta (M) and yellow (Y) and a monochromatic mode for forming a monochromatic image using only black (K) toner. In FIG. 1, the image forming apparatus comprises a line head 29 for forming images corresponding to the respective colors. FIG. 1 is a diagram corresponding to the execution of the color mode.

In FIG. 2, in this image forming apparatus 1, when an image formation command is given from an external apparatus such as a host computer to a main controller MC having a CPU and memories, the main controller MC feeds a control signal and the like to an engine controller EC and feeds video data VD corresponding to the image formation command to a head controller HC. This head controller HC controls line heads 29 of the respective colors based on the video data VD from the main controller MC, a vertical synchronization signal Vsync from the engine controller EC and parameter values from the engine controller EC. In this way, an engine part EG performs a specified image forming operation to form an image corresponding to the image formation command on a sheet such as a copy sheet, transfer sheet, form sheet or transparent sheet for OHP.

In FIG. 1, the image forming apparatus comprises a housing main body 3. An electrical component box 5 having a power supply circuit board, the main controller MC, the engine controller EC and the head controller HC built therein is disposed in the housing main body 3. An image forming unit 7, a transfer belt unit 8 and a sheet feeding unit 11 are also arranged in the housing main body 3. Further, a secondary transfer unit 12, a fixing unit 13, and a sheet guiding member 15 are arranged in the housing main body 3. It should be noted that the sheet feeding unit 11 and the transfer belt unit 8 are so constructed as to be detachable for repair or exchange.

The image forming unit 7 includes four image forming stations Y (for yellow), M (for magenta), C (for cyan) and K (for black) for forming a plurality of images having different colors. Each of the image forming stations Y, M, C and K includes a photosensitive drum 21 as latent image carrier on the surface of which a toner image of the corresponding color is to be formed. Each photosensitive drum 21 is connected to its own drive motor and is driven to rotate at a specified speed in a direction of arrow D21 in FIG. 1, whereby the surface 211 of the photosensitive drum 21, which serves as the surface-to-be-scanned, is conveyed in a sub scanning direction.

A charger 23, the line head 29, a developer 25 and a photosensitive drum cleaner 27 are arranged in a rotating direction around each photosensitive drum 21. A charging operation, a latent image forming operation and a toner developing operation are performed by these sections. A color image is formed by superimposing toner images formed by all the image forming stations Y, M, C and K on a transfer belt 81 of the transfer belt unit 8 at the time of executing the color mode, and a monochromatic image is formed using only a toner image formed by the image forming station K at the time of executing the monochromatic mode. Meanwhile, since the respective image forming stations of the image forming unit 7 are identically constructed in FIG. 1, reference numerals are given to only some of the image forming stations while being not given to the other image forming stations in order to facilitate the diagrammatic representation.

The charger 23 includes a charging roller having the surface thereof made of an elastic rubber. This charging roller is constructed to be rotated by being held in contact with the surface of the photosensitive drum 21 at a charging position. As the photosensitive drum 21 rotates, the charging roller is rotated at the same circumferential speed in a direction driven by the photosensitive drum 21. This charging roller is connected to a charging bias generator not shown and charges the surface 211 of the photosensitive drum 21 at the charging position where the charger 23 and the photosensitive drum 21 are in contact upon receiving the supply of a charging bias from the charging bias generator.

Each line head 29 includes a plurality of luminous elements arrayed in the longitudinal direction of the photosensitive drum 21 (direction normal to the plane of FIG. 1) and is positioned separated from the photosensitive drum 21. Light beams are emitted from these luminous elements to the surface of the photosensitive drum 21 charged by the charger 23, thereby forming a latent image on this surface. In this embodiment, the head controller HC is provided to control the line heads 29 of the respective colors, and controls the respective line heads 29 based on the video data VD from the main controller MC and a signal from the engine controller EC.

The line head 29 emits light beams to the surface 211 of the photosensitive drum 21 charged by the charger 23, thereby forming an electrostatic latent image on this surface 211. The control of the line head 29 is described in detail hereinafter based on FIG. 2 Image data included in an image formation command is inputted to an image processor 51 of the main controller MC. Then, video data VD of the respective colors are generated by applying various image processings to the image data, and the video data VD are fed to the head controller HC via a main-side communication module 52. In the head controller HC, the video data VD are fed to a head control module 54 via a head-side communication module 53. Signals representing parameter values relating to the formation of a latent image and the vertical synchronization signal Vsync are fed to this head control module 54 from the engine controller EC as described above. The head controller HC generates signals for controlling the driving of the elements of the line heads 29 of the respective colors and outputs them to the respective line heads 29. In this way, the operations of the luminous elements 2951 (see FIG. 3) in the respective line heads 29 are suitably controlled to form electrostatic latent images corresponding to the image formation command. Meanwhile, the structure of the line head 29 which comprises the luminous elements 2951 will be described in detail later.

In FIG. 1, the developer 25 includes a developing roller 251 carrying toner on the surface of the developing roller 251. By a development bias applied to the developing roller 251 from a development bias generator which is not shown and is electrically connected to the developing roller 251, charged toner is transferred from the developing roller 251 to the photosensitive drum 21 to develop the electrostatic latent image formed by the line head 29 at a development position where the developing roller 251 and the photosensitive drum 21 are in contact, whereby a toner image is formed.

The toner image developed at the development position in this way is primarily transferred to the transfer belt 81 at a primary transfer position TR1 to be described later where the transfer belt 81 and each photosensitive drum 21 are in contact after being conveyed in the rotating direction D21 of the photosensitive drum 21.

Further, the photosensitive drum cleaner 27 is disposed in contact with the surface 211 of the photosensitive drum 21 downstream of the primary transfer position TR1 and upstream of the charger 23 with respect to the rotating direction D21 of the photosensitive drum 21. This photosensitive drum cleaner 27 removes the toner remaining on the surface 211 of the photosensitive drum 21 to clean after the primary transfer by being held in contact with the surface 211 of the photosensitive drum 21.

Further, the photosensitive drum 21, the charger 23, the developer 25 and the photosensitive drum cleaner 27 of each of the image forming stations Y, M, C and K are unitized as a photosensitive cartridge. Further, each photosensitive cartridge includes a nonvolatile memory for storing information on the photosensitive cartridge. Wireless communication is performed between the engine controller EC and the respective photosensitive cartridges. By doing so, the information on the respective photosensitive cartridges is transmitted to the engine controller EC and information in the respective memories can be updated and stored.

The transfer belt unit 8 includes a driving roller 82, a driven roller (blade facing roller) 83 arranged to the left of the driving roller 82 in FIG. 1, and the transfer belt 81 mounted on these rollers and driven to turn in a direction of arrow D81 in FIG. 1 (conveying direction). The transfer belt unit 8 also includes four primary transfer rollers 85Y, 85M, 85C and 85K arranged to face in a one-to-one relationship with the photosensitive drums 21 of the respective image forming stations Y, M, C and K inside the transfer belt 81 when the photosensitive cartridges are mounted. These primary transfer rollers 85Y, 85M, 85C and 85K are respectively electrically connected to a primary transfer bias generator not shown. As described in detail later, at the time of executing the color mode, all the primary transfer rollers 85Y, 85M, 85C and 85K are positioned on the sides of the image forming stations Y, M, C and K as shown in FIG. 1, whereby the transfer belt 81 is pressed into contact with the photosensitive drums 21 of the image forming stations Y, M, C and K to form the primary transfer positions TR1 between the respective photosensitive drums 21 and the transfer belt 81. By applying primary transfer biases from the primary transfer bias generator to the primary transfer rollers 85Y, 85M, 85C and 85K at suitable timings, the toner images formed on the surfaces 211 of the respective photosensitive drums 21 are transferred to the surface of the transfer belt 81 at the corresponding primary transfer positions TR1 to form a color image.

On the other hand, out of the four primary transfer rollers 85Y, 85M, 85C and 85K, the color primary transfer rollers 85Y, 85M, 85C are separated from the facing image forming stations Y, M and C and only the monochromatic primary transfer roller 85K is brought into contact with the image forming station K at the time of executing the monochromatic mode, whereby only the monochromatic image forming station K is brought into contact with the transfer belt 81. As a result, the primary transfer position TR1 is formed only between the monochromatic primary transfer roller 85K and the image forming station K. By applying a primary transfer bias at a suitable timing from the primary transfer bias generator to the monochromatic primary transfer roller 85K, the toner image formed on the surface 211 of the photosensitive drum 21 is transferred to the surface of the transfer belt 81 at the primary transfer position TR1 to form a monochromatic image.

The transfer belt unit 8 further includes a downstream guide roller 86 disposed downstream of the monochromatic primary transfer roller 85K and upstream of the driving roller 82. This downstream guide roller 86 is so disposed as to come into contact with the transfer belt 81 on an internal common tangent to the primary transfer roller 85K and the photosensitive drum 21 at the primary transfer position TR1 formed by the contact of the monochromatic primary transfer roller 85K with the photosensitive drum 21 of the image forming station K.

The sheet feeding unit 11 includes a sheet feeding section which has a sheet cassette 77 capable of holding a stack of sheets, and a pickup roller 79 which feeds the sheets one by one from the sheet cassette 77. The sheet fed from the sheet feeding section by the pickup roller 79 is fed to the secondary transfer position TR2 along the sheet guiding member 15 after having a sheet feed timing adjusted by a pair of registration rollers 80.

The secondary transfer unit 12 includes a secondary transfer roller 121 and the driving roller 82. The driving roller 82 drives to rotate the transfer belt 81 in a direction of arrow D81 and doubles as a backup roller for the secondary transfer roller 121. A rubber layer having a thickness of about 3 mm and a volume resistivity of 1000 kΩ·cm or lower is formed on the circumferential surface of the driving roller 82 and is grounded via a metal shaft, thereby serving as an electrical conductive path for a secondary transfer bias to be supplied from an unillustrated secondary transfer bias generator via the secondary transfer roller 121. By providing the driving roller 82 with the rubber layer having high friction and shock absorption, an impact caused upon the entrance of a sheet into a contact part of the driving roller 82 and the secondary transfer roller 121, which is a secondary transfer position TR2, is unlikely to be transmitted to the transfer belt 81 and image deterioration can be prevented. The secondary transfer roller 121 is disposed freely movably toward and away from the transfer belt 81, and is driven to move toward and away from the transfer belt 81 by a secondary transfer roller driving mechanism not shown. The image transferred to the transfer belt 81 is secondarily transferred to the sheet which is fed to the secondary transfer position TR2.

The fixing unit 13 includes a heating roller 131 which is freely rotatable and has a heating element such as a halogen heater built therein, and a pressing section 132 which presses this heating roller 131. The pressing section 132 includes two rollers 1321 and 1322 and the pressure belt 1323 mounted on these rollers. The sheet to which an image is secondarily transferred is guided to a nip portion formed between the heating roller 11 and a pressure belt 1323 of the pressing section 132 by the sheet guiding member 15, and the image is thermally fixed at a specified temperature in this nip portion. Out of the surface of the pressure belt 1323, a part stretched by the two rollers 1321 and 1322 is pressed against the circumferential surface of the heating roller 131, thereby forming a sufficiently wide nip portion between the heating roller 131 and the pressure belt 1323. The sheet having been subjected to the image fixing operation is conveyed to the discharge tray 4 provided on the upper surface of the housing main body 3.

A cleaner 71 is disposed facing the blade facing roller 83 in the image forming apparatus 1. The cleaner 71 includes a cleaner blade 711 and a waste toner box 713. The cleaner blade 711 removes foreign matters such as toner remaining on the transfer belt after the secondary transfer and paper powder by holding the leading end thereof in contact with the blade facing roller 83 via the transfer belt 81. Foreign matters thus removed are collected into the waste toner box 713. Further, the cleaner blade 711 and the waste toner box 713 are constructed integral to the blade facing roller 83.

Accordingly, if the blade facing roller 83 moves as described next, the cleaner blade 711 and the waste toner box 713 move together with the blade facing roller 83.

Figure 3:
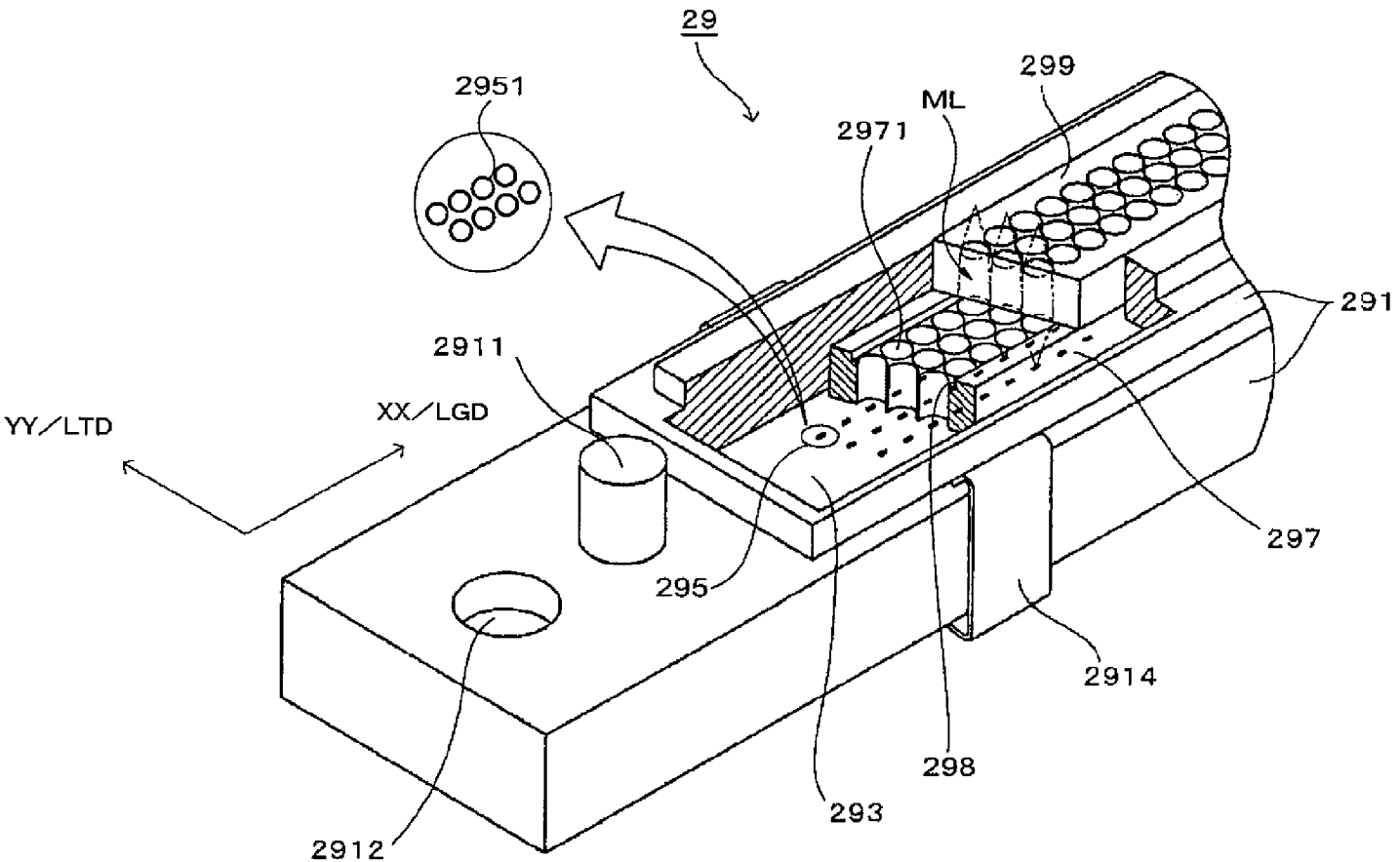
FIG. 3 is a perspective view schematically showing the line head.
Figure 4:
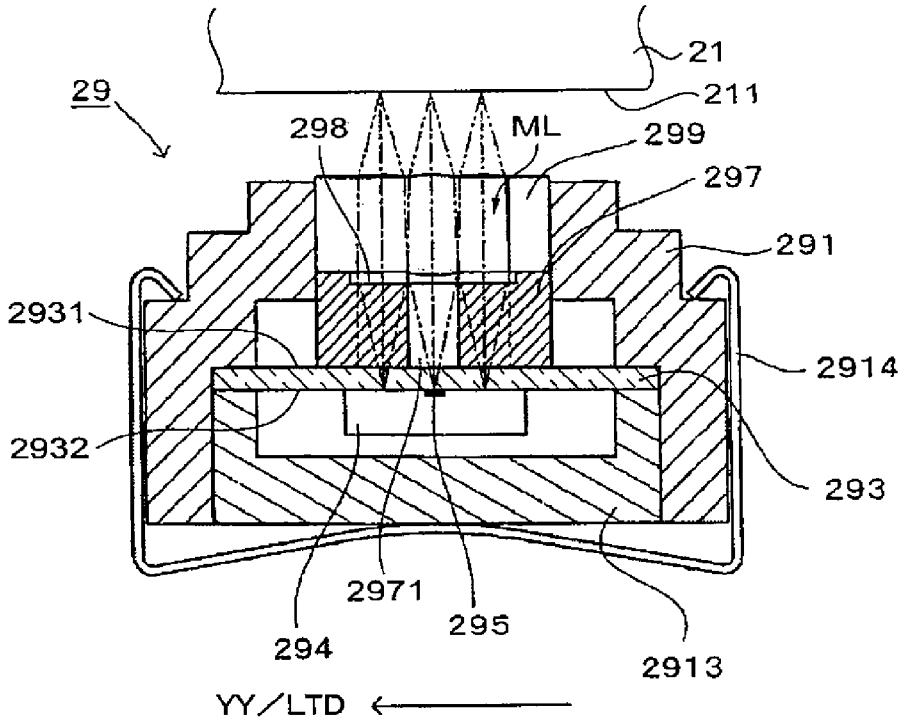
FIG. 4 is a sectional view of the line head in a width direction which corresponds to the sub scanning direction.

The line head 29 is described in detail with reference to drawings hereinafter. FIG. 3 is a perspective view schematically showing the line head 29. FIG. 4 is a sectional view of the line head 29 in a width direction LTD which corresponds to the sub scanning direction YY. In FIGS. 1 and 3, the line head 29 comprises a luminous element group 295 which includes a plurality of luminous elements 2951 arrayed in the axial direction of the photosensitive drum 21 (direction normal to the plane of FIG. 1) and is positioned separated from the photosensitive drum 21. Light beams are emitted from these luminous elements 2951 to the surface 211 of the photosensitive drum 21 which is a surface-to-be-scanned and which is charged by the charger 23, thereby forming an electrostatic latent image on the surface 211.

In FIG. 3, the line head 29 includes a case 291 of which the longitudinal direction LGD is parallel to a main scanning direction XX. A positioning pin 2911 and a screw insertion hole 2912 are provided at each of the opposite ends of the case 291. The line head 29 is positioned with respect to the photosensitive drum 21 by fitting the positioning pins 2911 into positioning holes formed in a photosensitive drum cover not shown covering the photosensitive drum 21. Further, the line head 29 is fixed with respect to the photosensitive drum 21 by screwing fixing screws into screw holes (not shown) of the photosensitive drum cover through the screw insertion holes 2912. That is, the line head 29 is arranged such that the longitudinal direction LGD of the line head 29 corresponds to the main scanning direction XX, and that the width direction LTD of the line head 29 corresponds to the sub scanning direction YY.

In FIGS. 3 and 4, the case 291 carries a microlens array 299 in which microlenses ML as imaging lenses are arrayed at a position facing the surface 211 of the photosensitive drum 21, and includes, inside thereof, a light shielding part 297 and a glass substrate 293 as a substrate in this order from the microlens array 299. The glass substrate 293 is a transparent substrate. The microlens array 299, the light shielding part 297 and the glass substrate 293 have an outer shape of approximate rectangular parallelepiped of which the longitudinal direction LGD is parallel to the main scanning direction XX. A stepped portion 298 is provided on a surface of the light shielding part 297 which is opposed to the region in which the microlenses ML are arrayed. The stepped portion 298 separates the microlenses ML and the light shielding part 297 in which light guiding holes 2971 which are opposed to the microlenses ML are formed. A plurality of luminous element groups 295 are arranged on the underside surface 2932 of the glass substrate 293 (surface opposite to the top surface 2931 which is opposed to the light shielding part 297 out of two surfaces of the glass substrate 293). As shown in FIG. 3, the plurality of luminous element groups 295 are two-dimensionally and discretely arranged on the underside surface 2932 of the glass substrate 293 while being spaced apart at specified intervals from each other in the longitudinal direction LGD which corresponds to the main scanning direction XX and in the width direction LTD which corresponds to the sub scanning direction YY. Here, each of the plurality of luminous element groups 295 is composed of a plurality of two-dimensionally arranged luminous elements 2951 as shown in the encircled portion in FIG. 3. Further, an organic EL (electroluminescence) device is used as the luminous element. In other words, the organic EL devices are arranged on the underside surface 2932 of the glass substrate 293 as the luminous elements. The light beams emitted from of the respective plurality of the luminous elements 2951 in a direction toward the photosensitive drum 21 are headed for the light shielding part 297 via the glass substrate 293. It should be noted that light emitting diodes may be used as the luminous elements.

In FIGS. 3 and 4, the light shielding part 297 is formed with a plurality of light guiding holes 2971 which are in a one-to-one correspondence with the plurality of luminous element groups 295. That is, the plurality of light guiding holes 2971 are provided in the light shielding part 297 such that each light guiding hole 2971 corresponds one-to-one to each of the plurality of luminous element groups 295. Each of the light guiding holes 2971 is in the form of a substantial cylinder whose central axis (denoted at dashed-dotted line in FIG. 4) is parallel to a perpendicular line to the surface of the glass substrate 293, and penetrates the light shielding part 297. That is, the light beam emitted from the luminous element 2951 belonging to a luminous element group 295 is guided to the microlens ML by means of the light guiding hole 2971 which corresponds to the luminous element group 295. The light beams having passed through the light guiding holes 2971 formed in the light shielding part 297 are focused as spots on the surface 211 of the photosensitive drum 21 by means of the microlens ML as shown in FIG. 4 denoted at dashed-two dotted line.

As shown in FIG. 4, an underside lid 2913 is pressed to the case 291 via the glass substrate 293 by a retainer 2914. Specifically, the retainer 2914 has an elastic force to press the underside lid 2913 toward the case 291, and seals the inside of the case 291 light-tight (that is, so that light does not leak from the inside of the case 291 and so that light does not intrude into the case 291 from the outside) by pressing the underside lid 2913 by means of the elastic force. It should be noted that a plurality of the retainers 2914 are provided at a plurality of positions in the longitudinal direction LGD of the case 291. The luminous element groups 295 are covered with a sealing member 294.

Figure 5:
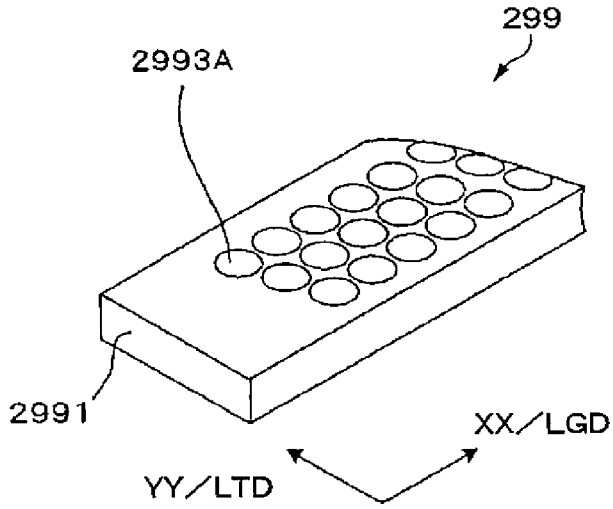
FIG. 5 is a perspective view schematically showing the microlens array.
Figure 6:
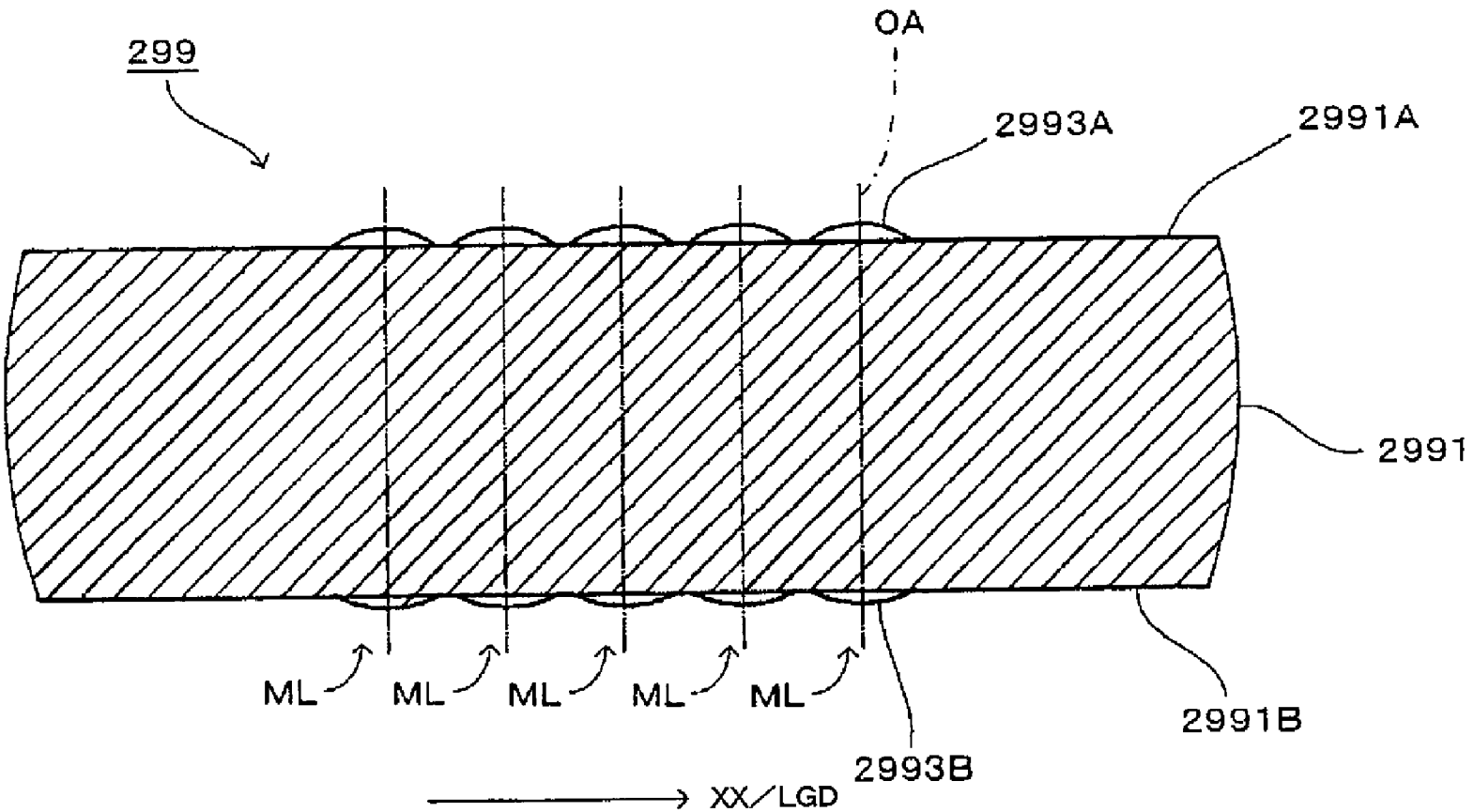
FIG. 6 is a sectional view of the microlens array in the longitudinal direction which corresponds to the main scanning direction.

FIG. 5 is a perspective view schematically showing the microlens array 299, and FIG. 6 is a sectional view of the microlens array 299 in the longitudinal direction LGD which corresponds to the main scanning direction XX. The microlens array 299 includes a glass substrate 2991 and a plurality of lens pairs each comprised of two lenses 2993A and 2993B which are arranged in a one-to-one correspondence at the opposite sides of the glass substrate 2991. Meanwhile, these lenses 2993A and 2993B can be made of resin.

The microlens ML is described in detail hereinafter. In FIG. 6, a plurality of lenses 2993A are arranged on a top surface 2991A of the glass substrate 2991, and a plurality of lenses 2993B are so arranged on an underside surface 2991B of the glass substrate 2991 as to correspond one-to-one to the plurality of lenses 2993A. Further, two lenses 2993A and 2993B constituting a lens pair have a common optical axis OA denoted at dashed-dotted line in FIG. 6. These plurality of lens pairs are arranged in a one-to-one correspondence with the plurality of luminous element groups 295. Meanwhile, in this specification, an optical system which includes lenses 2993A and 2993B constituting a pair of one to one and the glass substrate 2991 located between the lens pair is called "microlens ML". The microlenses ML as the imaging lenses are, corresponding to the arrangement of the luminous element groups 295, two-dimensionally arranged and spaced apart from each other at specified intervals in the longitudinal direction LGD which corresponds to the main scanning direction XX and in the width direction LTD which corresponds to the sub scanning direction YY.

Figure 7:
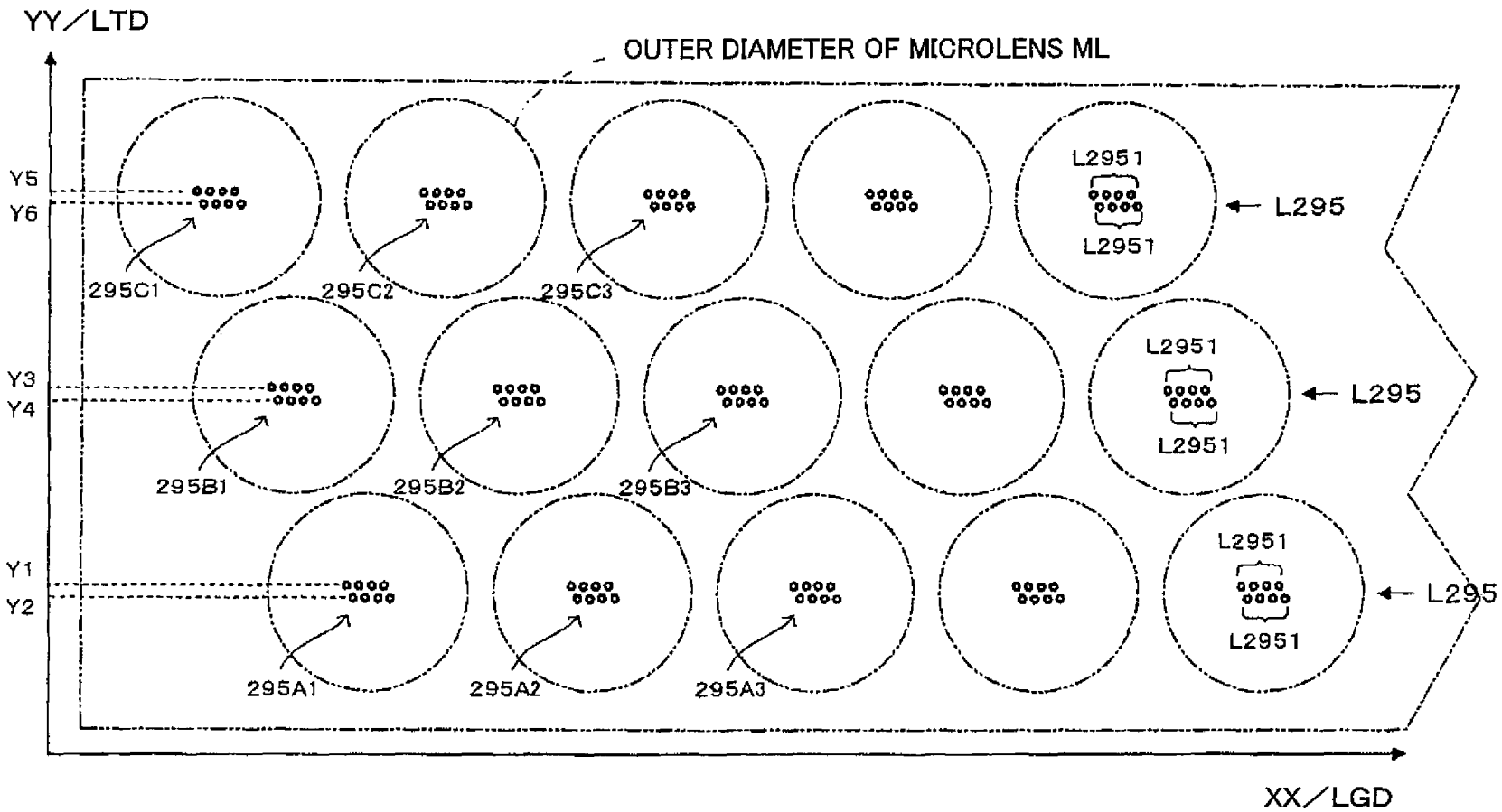
FIG. 7 is a diagram showing the arrangement of the plurality of the luminous element groups.

FIG. 7 is a diagram showing the arrangement of the plurality of the luminous element groups 295. In this embodiment, one luminous element group 295 is constructed by arranging two luminous element lines L2951, each of which is formed by arranging four luminous elements 2951 at specified intervals in the longitudinal direction LGD which corresponds to the main scanning direction XX, in the width direction LTD which corresponds to the sub scanning direction YY. In other words, eight luminous elements 2951 corresponding to one circular microlens ML denoted at dashed-two dotted line in FIG. 7 constitute one luminous element group 295. And a plurality of luminous element groups 295 are arranged as follows.

The luminous element groups 295 are two-dimensionally arranged such that three luminous element group lines (group line) L295, each of which is formed by arranging a specified number (more than one) of luminous element groups in the longitudinal direction LGD which corresponds to the main scanning direction XX, are arranged in the width direction LTD which corresponds to the sub scanning direction YY. All the luminous element groups 295 are arranged at mutually different main-scanning-direction positions. Further, the plurality of luminous element groups 295 are arranged such that the luminous element groups having adjacent main-scanning-direction positions (for example, luminous element group 295C1 and luminous element group 295B1) are located at different sub-scanning-direction positions. Meanwhile, the main-scanning-direction position and the sub-scanning-direction position mean a main scanning direction component and a sub scanning direction component of a target position respectively. Further, in this specification, "the geometric center of gravity of the luminous element group" means the geometric center of gravity of the positions of all the luminous elements 2951 belonging to the same luminous element group 295.

As shown in FIG. 4, the light guiding holes 2971 are perforated in the light shielding part 297 and the microlenses ML are arranged corresponding to the arrangement of such luminous element groups 295. In other words, the center of gravity positions of the luminous element groups 295, the central axes of the light guiding holes 2971 and the optical axes OA of the microlenses ML substantially coincide in this embodiment. As shown in FIG. 4, the light beams emitted from the luminous elements 2951 of the luminous element groups 295 are incident on the microlens array 299 via the corresponding light guiding holes 2971 and imaged as spots on the surface 211 of the photosensitive drum 21 by the microlens array 299.

Figure 8:
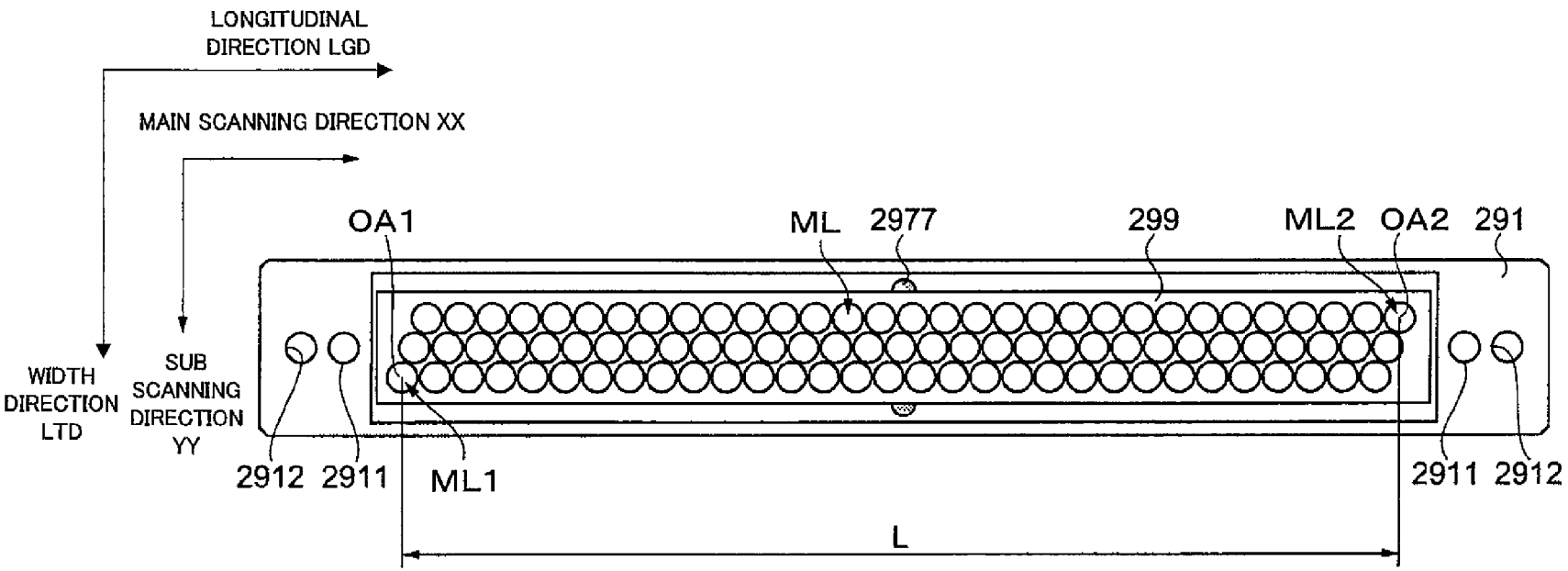
FIG. 8 is a plan view of the line head as it is housed in the case.
Figure 9:
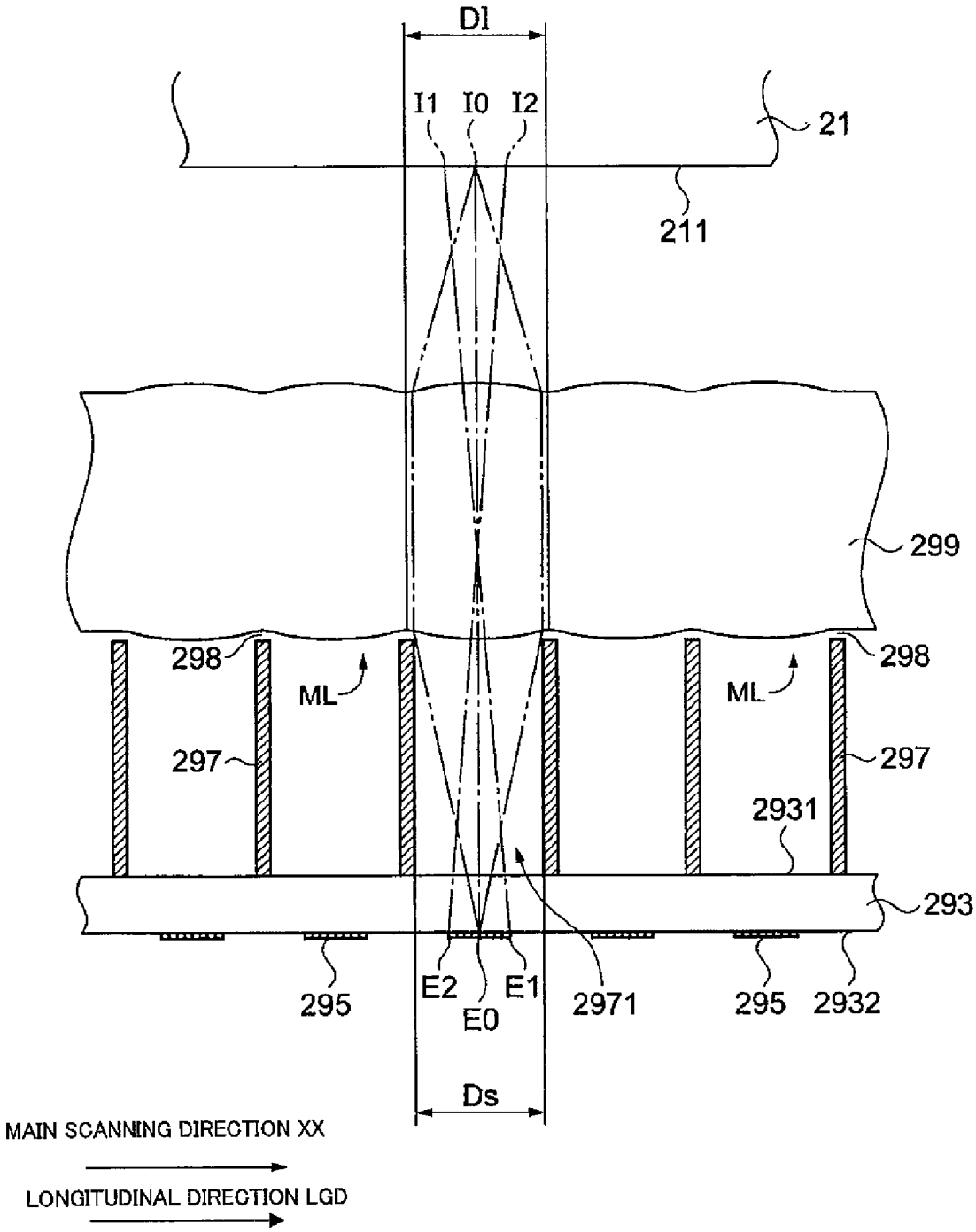
FIG. 9 is a diagram which shows an imaging state of the microlens array.

FIG. 8 is a plan view of the line head 29 as it is housed in the case 291. The light shielding part 297 is formed by one light shielding member. FIG. 9 is a diagram which shows an imaging state of the microlens array 299. In FIG. 8, a central portion of the light shielding part 297 not shown positioned below the microlens array 299 is fixed to the microlens array 299 by a fixing adhesive 2977. The symbol L denotes a length between the optical axes OA of the microlenses ML which are at the both ends of the longitudinal direction LGD (main scanning direction XX) of the microlens array 299 (that is, the symbol L denotes a distance between the optical axis OA1 and the optical axis OA2 in the longitudinal direction LGD). In FIG. 9, the symbol Ds denotes the inner diameter of the light guiding hole 2971 in the longitudinal direction, and the symbol D1 denotes the bore diameter of the microlens in the longitudinal direction. Once L is determined, the relationship between Ds and D1 is determined so as to satisfy Formula 1:

$$D1-(\alpha s-\alpha m)\cdot L\cdot T\geqq Ds \qquad \text{Formula 1}$$

where the symbol am denotes the linear expansion coefficient of the microlens array 299 in the longitudinal direction and the symbol as denotes the linear expansion coefficient of the light shielding part 297 in the longitudinal direction, and the symbol T denotes a temperature range in use for the line head 29. The table below shows the values of Ds and D1 when L is 320 mm, the temperature range in use T is 30° C., the material of the light shielding part 297 is iron, titanium or stainless steel and the material of the glass substrate 2991 of the microlens array 299 is glass or heat resistant glass, for instance.

TABLE 1

| NUMERICAL EXAMPLE | MATERIAL OF LIGHT SHIELDING PART | αs | MATERIAL OF GLASS SUBSTRATE | αm | Ds [mm] | D1 [mm] |
|---|---|---|---|---|---|---|
| 1 | IRON | $1.30 \times 10^{-5}$ | GLASS | $0.90 \times 10^{-5}$ | 0.85 | 0.90 |
| 2 | TITANIUM | $0.84 \times 10^{-5}$ | HEAT RESISTANT GLASS | $0.38 \times 10^{-5}$ | 0.85 | 0.90 |
| 3 | STAINLESS STEEL | $1.65 \times 10^{-5}$ | GLASS | $0.90 \times 10^{-5}$ | 0.80 | 0.90 |

The imaging state of the spots on the surface 211 of the photosensitive drum 21 by means of the microlens array 299 will now be described. In FIG. 9, the luminous element groups 295 are disposed on the underside surface 2932 of the glass substrate 293. The microlenses ML are disposed corresponding to the luminous element groups 295. Further, the light shielding part 297 is disposed such that its one surface is opposed to the top surface 2931 of the glass substrate 293 and its other surface is opposed to the microlenses ML. The light guiding holes 2971 penetrate the light shielding parts 297 from one surface to the other surface of the light shielding parts 297, corresponding to the luminous element groups 295. In addition, the light guiding hole 2971 is perforated axially symmetrically with respect to the optical axis OA of the corresponding microlens ML. Further, since the surface opposed to the microlenses ML of the light shielding part 297 has the stepped portions 298 which are separated from the microlenses ML as shown also in FIGS. 3 and 4, even when the microlens array 299 and the light shielding part 297 expand or contract due to a temperature change and their relative positions shift, the microlens array 299 and the light shielding part 297 do not contact. For example, when the bore diameter of the microlenses ML is 900 μm and the longitudinal length of the microlenses ML is 300 mm, the shift is 20 through 30 μm. The longer the lengths of the microlens array 299, the light shielding part 297 and the glass substrate 293 in the main scanning direction XX which is the longitudinal direction LGD are, the greater the shift of the relative positions due to a temperature change is.

Further, for representation of the imaging property of the microlens array 299, in these drawings, the dashed-dotted line denotes the trajectory of a principal ray of a light beam from the geometric center of gravity E0 of the luminous element group 295 and positions E1 and E2 which are separated by predetermined gaps from the geometric center of gravity E0. As the trajectory shows, the light beam emitted from each position impinges upon the underside surface 2932 of the glass substrate 293 and thereafter leaves the top surface 2931 of the glass substrate 293. Leaving the top surface 2931 of the glass substrate 293, the light beam reaches the surface 211 of the photosensitive drum 21 which is the surface-to-be-scanned, via the microlens array 299.

The light beam emitted from the position of the geometric center of gravity E0 of the luminous element group 295 is imaged on an intersection I0 of the surface 211 of the photosensitive drum 21 and the optical axis OA of the microlens ML shown in FIG. 6. This results from the fact that the position of the geometric center of gravity E0 of the luminous element group 295 lies on the optical axis OA of the microlens ML in this embodiment as described above. Further, the light beams emitted from the positions E1 and E2 are imaged at positions I1 and I2 of the surface 211 of the photosensitive drum 21, respectively. Specifically, the light beam emitted from the position E1 is imaged at the position I1 at an opposite side of the optical axis OA of the microlens ML with respect to the main scanning direction XX, and the light beam emitted from the position E2 is imaged at the position I2 at an opposite side of the optical axis OA of the microlens ML with respect to the main scanning direction XX. In other words, the microlens ML is a so-called inverting optical system having an inverting property.

Further, a distance between the positions I1 and I0 where the light beams are imaged is longer than a distance between the positions E1 and E0. That is to say that the absolute value of the magnification of the above optical system in this embodiment is more than 1. In other words, the above optical system in this embodiment is a so-called magnifying optical system having a magnifying property. In this embodiment, the microlens ML thus functions as the "imaging lens" of the invention.

Figure 10:
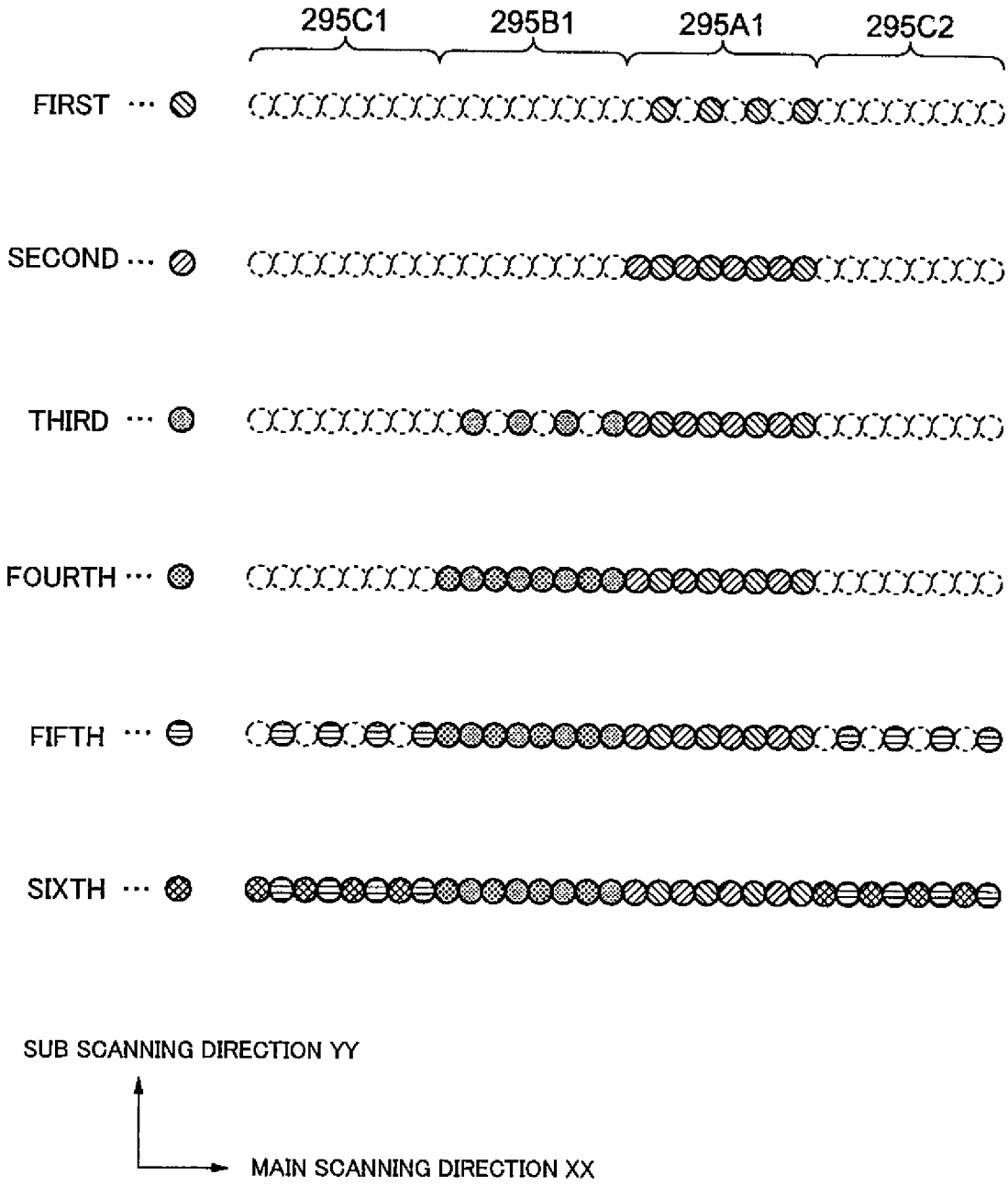
FIG. 10 is a diagram showing the spot forming operation by the line head.

FIG. 10 is a diagram showing the spot forming operation by the line head 29. The spot forming operation by the line head according to this embodiment is described below with reference to FIGS. 2, 7 and 10. In order to make the invention easily understandable, here is described the case where a plurality of spots are formed side by side on a straight line extending in the main scanning direction XX. In this embodiment, a plurality of spots are formed side by side on a straight line extending in the main scanning direction XX by causing a plurality of luminous elements to emit light beams at specified timings by the head control module 54 while the surface 211 of the photosensitive drum 21 is conveyed in the sub scanning direction YY.

In FIG. 7, in the line head 29 of this embodiment, six groups of luminous element lines L2951 are arranged in the sub scanning direction YY (the width direction LTD) corresponding to sub-scanning-direction positions Y1 to Y6. In this embodiment, the luminous element lines L2951 at the same sub-scanning-direction position are caused to emit light beams substantially at the same timing and the luminous element lines L2951 at different sub-scanning-direction positions are caused to emit light beams at different timings from each other. More specifically, the luminous element lines L2951 are caused to emit light beams in the order of the sub-scanning-direction positions Y1 to Y6. By causing the luminous element lines L2951 to emit light beams in the above order while conveying the surface 211 of the photosensitive drum 21 in the sub scanning direction YY, a plurality of spots are formed side by side on a straight line extending in the main scanning direction XX on the surface 211.

Such an operation is described with reference to FIGS. 7 and 10. First of all, the luminous elements 2951 of the luminous element lines L2951 at the sub-scanning-direction position Y1 belonging to the luminous element groups 295A1, 295A2, 295A3, . . . which are located most upstream in the sub scanning direction YY are caused to emit light beams. A plurality of light beams emitted by such a light emitting operation are imaged on the surface 211 of the photosensitive drum 21 while being inverted and magnified by the "imaging lens" having the above inverting and magnifying property. In other words, spots are formed at hatched positions of the "first" light emitting operation of FIG. 10. In FIG. 10, outline circles represent spots not formed yet, but planned to be formed later. Further, in FIG. 10, spots labeled with reference characters 295C1, 295B1, 295A1 and 295C2 are those to be formed by the luminous element groups 295 corresponding to the respectively assigned reference characters.

Subsequently, the luminous elements 2951 of the luminous element lines L2951 at the sub-scanning-direction position Y2 belonging to the same luminous element groups 295A1, 295A2, 295A3, . . . are caused to emit light beams. A plurality of light beams emitted by such a light emitting operation are imaged on the surface 211 of the photosensitive drum 21 while being inverted and magnified by the microlenses ML. In other words, spots are formed at hatched positions of the "second" light emitting operation in FIG. 10. Here, in order to cope with the inverting property of the microlenses ML, the surface 211 of the photosensitive drum 21 is conveyed in the sub scanning direction YY while the luminous element lines L2951 are caused to emit light beams from the downstream side with respect to the sub scanning direction YY (that is, in the order of the sub-scanning-direction positions Y1 and Y2).

Next, the luminous elements 2951 of the luminous element lines L2951 at the sub-scanning-direction position Y3 belonging to the luminous element groups 295B1, 295B2, 295B3, . . . , which are second from the upstream side in the sub scanning direction YY, are caused to emit light beams. A plurality of light beams emitted by such a light emitting operation are imaged on the surface 211 of the photosensitive drum 21 while being inverted and magnified by the microlenses ML. In other words, spots are formed at hatched positions of the "third" light emitting operation of FIG. 10.

Subsequently, the luminous elements 2951 of the luminous element lines L2951 at the sub-scanning-direction position Y4 belonging to the same luminous element groups 295B1, 295B2, 295B3, . . . are caused to emit light beams. A plurality of light beams emitted by such a light emitting operation are imaged on the surface 211 of the photosensitive drum 21 while being inverted and magnified by the microlenses ML. In other words, spots are formed at hatched positions of the "fourth" light emitting operation of FIG. 10.

Subsequently, the luminous elements 2951 of the luminous element lines L2951 at the sub-scanning-direction position Y5 belonging to the luminous element groups 295C1, 295C2, 295C3, . . . , which are most-downstream side in the sub scanning direction YY, are caused to emit light beams. A plurality of light beams emitted by such a light emitting operation are imaged on the surface 211 of the photosensitive drum 21 while being inverted and magnified by the microlenses ML. In other words, spots are formed at hatched positions of the "fifth" light emitting operation of FIG. 10.

Finally, the luminous elements 2951 of the luminous element lines L2951 at the sub-scanning-direction position Y6 belonging to the same luminous element groups 295C1, 295C2, 295C3, . . . are caused to emit light beams. A plurality of light beams emitted by such a light emitting operation are imaged on the surface 211 of the photosensitive drum 21 while being inverted and magnified by the microlenses ML. In other words, spots are formed at hatched positions of the "sixth" light emitting operation of FIG. 10. In this way, a plurality of spots are formed side by side on the straight line extending in the main scanning direction XX by performing the first to sixth light emitting operations.

According to the foregoing embodiment, the following effect is obtained. That is, in the longitudinal direction in which shift of the relative positions is large due to a difference between the coefficient of thermal expansion of the material of the microlens array 299 and that of the material of the light shielding parts 297, the inner diameter Ds of the light guiding holes 2971 in the longitudinal direction is smaller than the bore diameter D1 of the microlenses ML in the longitudinal direction. At this stage, even when the light shielding part 297 expands or contracts due to a temperature change, shifting the relative positions of the light guiding holes 2971 to the microlenses ML to which the light guiding holes 2971 are opposed, the likelihood that the light guiding holes 2971 will move to outside the range of the bore diameter of the microlenses ML is reduced. Hence, the light beams passing through the light guiding holes 2971 are guided to the opposed microlenses ML, which reduces incidence upon other positions than the opposed microlenses ML, which makes it possible to suppress ghosts and to obtain the line head 29 which is capable of forming favorable spots.

Further, the inner diameter Ds of the light guiding holes 2971 of the light shielding part 297 and the bore diameter D1 of the microlenses ML have values yielded by Formula 1. According to Formula 1, the inner diameter Ds of the light guiding holes 2971 is smaller than the bore diameter D1 of the imaging lenses even despite a temperature change within the temperature range in use for the line head 29, thereby reducing the likelihood that the light shielding part 297 will expand or contract, the positions of the light guiding holes 2971 relative to the opposed microlenses ML will shift and the light guiding holes 2971 will get deviated from the range of the bore diameter of the microlenses ML.

$$D1-(\alpha s-\alpha m)\cdot L\cdot T \geqq Ds \qquad \text{Formula 1}$$

In addition, since the light shielding part 297 is fixed to the microlens array 299 at the vicinity of the central portions of the light shielding part 297 which are approximately equidistant from each end of the light shielding part 297 in the longitudinal direction, the positioning of the light shielding part 297 relative to the microlens array 299 can be more accurate. Further, since the light shielding part 297 is fixed to the microlens array 299 in the vicinity of the central portions of the light shielding part 297, the distance to each end 2980 can be approximately equal and shortened, and hence, expansion and contraction due to a temperature change from the fixed portions can be approximately equal and reduced, as compared with the case where the light shielding part 297 is fixed at the vicinity of each end of the light shielding parts 297. Therefore, the amount of shift caused by expansion and contraction are also approximately uniform and reduced, generation of ghost is suppressed, and the line head 29 which is capable of forming favorable spots can be obtained.

Further, since the apparatus comprises an exposure section whose structure is identical to that of the line head 29 which exhibits the effects described above, it is possible to suppress crosstalk and ghosts. It is therefore possible to obtain the image forming apparatus 1 which is capable of forming an image with spots which are imaged at their intended positions and ensuring less degradation of image quality.

Second Embodiment

Figure 11:
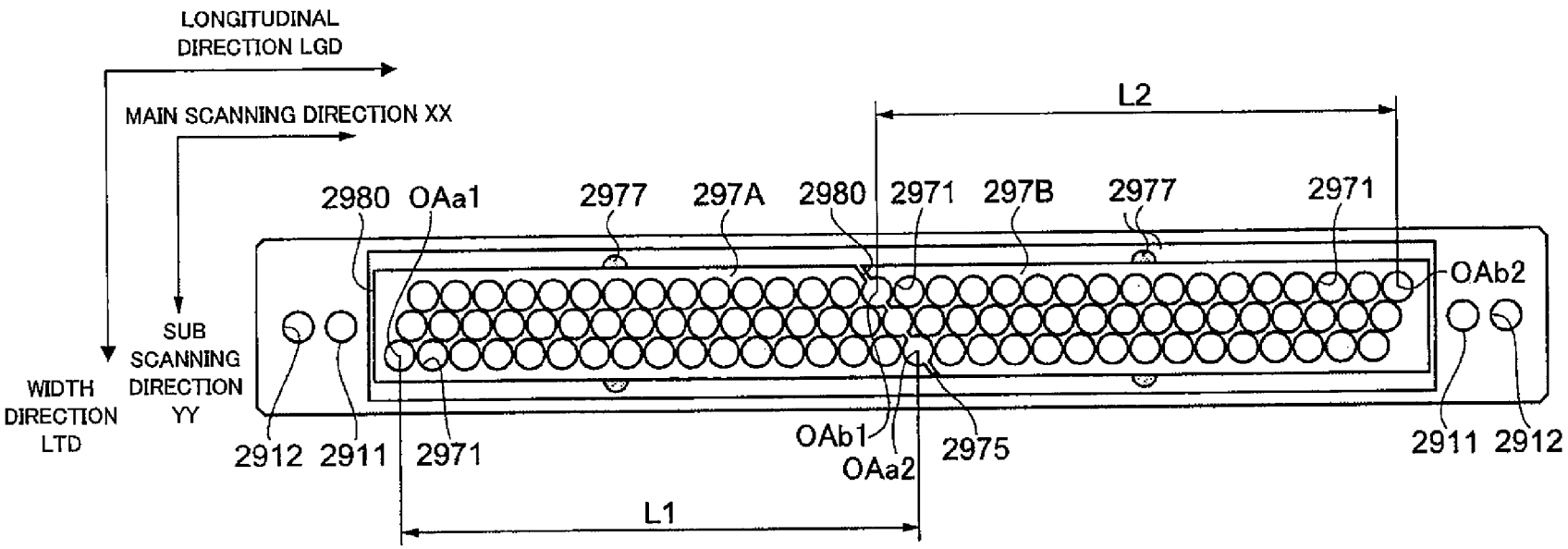
FIG. 11 is a plan view of other structure of the line head as it is housed in the case.

FIG. 11 is a plan view of other structure of the line head 29 as it is housed in the case 291. The microlens array 299 is omitted. The light shielding part 297 comprises a light shielding member 297A and a light shielding member 297B. The light shielding members 297A and 297B are disposed via a clearance 2975 in the longitudinal direction LGD which corresponds to the main scanning direction XX. The clearance 2975 is provided diagonally skewer three light guiding holes 2971 which are next to each other with their positions shifted from each other in the width direction LTD which corresponds to the sub scanning direction YY. Central portions of the light shielding members 297A and 297B which are approximately equidistant from the both ends of the 2980 of the light shielding members 297A and 297B in the longitudinal direction are fixed to the microlens array 299 not shown by the fixing adhesive 2977.

The symbol L1 denotes a length between the optical axes OA of the microlenses ML which are at the both ends of the light shielding member 297A and opposed to the light guiding holes 2971 (that is, the symbol L1 denotes a distance between the optical axis OAa1 and the optical axis OAa2 in the longitudinal direction LGD). The symbol L2 denotes a length between the optical axes OA of the microlenses ML which are at the both ends of the light shielding member 297B in the longitudinal direction and opposed to the light guiding holes 2971 (that is, the symbol L2 denotes a distance between the optical axis OAb1 and the optical axis OAb2 in the longitudinal direction LGD). The light guiding holes 2971 are perforated axially symmetrically with respect to the optical axes OA of the corresponding microlenses ML. With respect to the light shielding members 297A and 297B as well, the inner diameter Ds of the light guiding holes 2971 and the bore diameter D1 of the microlenses ML are formed so as to satisfy Formula 2 and Formula 3 below, respectively considering L1 and L2.

$$D1-(\alpha s-\alpha m)\cdot L1\cdot T\geqq Ds \qquad \text{Formula 2}$$

$$D1-(\alpha s-\alpha m)\cdot L2\cdot T\geqq Ds \qquad \text{Formula 3}$$

According to the foregoing embodiment, the following effects are obtained. That is, since the divided light shielding members 297A and 297B, each being short, have their relative positions shifted less than how much the relative position of one long light shielding member would shift. This reduces incidence of light beams from the luminous elements 2951 upon other positions than the opposed microlenses ML, suppresses ghosts and obtains the line head 29 which is capable of forming favorable spots. This is effective particularly when a temperature change may make the sizes of the inner diameter Ds and the bore diameter D1 significantly different from each other due to a large difference between the coefficient of thermal expansion of the material of the microlens array 299 and that of the material of the light shielding part 297 so that the inner diameter Ds needs be extremely small or the bore diameter D1 needs be extremely large.

In short, according to the first and the second embodiments, in the longitudinal direction in which the relative positions shift greatly because of a difference between the coefficient of thermal expansion of the material of the lens array and that of the light shielding part, the inner diameter Ds of the light guiding holes in the longitudinal direction is smaller than the bore diameter D1 of the imaging lenses in the longitudinal direction. Therefore, even when the light shielding part expands or contracts due to a temperature change and the relative positions of the light guiding holes to the opposed imaging lenses shift, the light guiding holes are less likely to move to outside the range of the bore diameter of the imaging lenses. This guides the light beams passing through the light guiding holes to the opposed imaging lenses, reduces incidence of the light beams upon other positions than the opposed imaging lenses, suppresses ghosts and obtains the line head which is capable of forming favorable spots.

Further, according to the first and the second embodiments, the light shielding part comprises one or plural light shielding members, the light shielding members have the light guiding holes, and the relationship expressed by Formula 1 is satisfied among the length L between the optical axes of the imaging lenses which are opposed to the light guiding holes which are at the both ends of the light shielding members in the longitudinal direction, the linear expansion coefficient am of the lens array in the longitudinal direction, the linear expansion coefficient as of the light shielding members in the longitudinal direction, the inner diameter Ds, the bore diameter D1 and the temperature range in use T, which is preferable.

$$D1-(\alpha s-\alpha m)\cdot L\cdot T\geqq Ds \qquad \text{Formula 1}$$

Further, according to the first and the second embodiments, the inner diameter Ds of the light guiding holes of the light shielding members and the bore diameter D1 of the imaging lenses have the values which are determined by Formula 1. According to Formula 1, even in the presence of a temperature change within the temperature range in use for the line head, since the inner diameter Ds of the light guiding holes is smaller than the bore diameter D1 of the imaging lenses, the likelihood is low that the light shielding member will expand or contract, the relative positions of the light guiding holes to the opposed imaging lenses will shift and move to outside the range of the bore diameter of the imaging lenses. In the event that the light shielding part is formed by plural light shielding members, the inner diameter Ds and the bore diameter D1 are determined so that each light shielding member satisfies Formula 1.

Further, according to the first and the second embodiments, the light shielding members are fixed to the lens array at positions which are approximately equidistant from the both ends of the light shielding members in the longitudinal direction, which is preferable. In these embodiments, the light shielding members are fixed to the lens array at the vicinity of the central portions, namely, positions which are approximately equidistant from the both ends of the light shielding members in the longitudinal direction, and therefore the relative positions of the light shielding members to the lens array are more accurately determined. In addition, as compared with fixing in the vicinity of the both ends of the light shielding members, fixing near the central portions approximately equally shortens distances to the both ends, and hence, approximately equally reduces expansion and contraction due to a temperature change from the fixed portions. This therefore approximately uniformly reduces shift caused by expansion and contraction, suppresses ghosts and obtains the line head which is capable of forming favorable spots.

Further, according to the first and the second embodiments, the substrate is a transparent substrate which can transmit light beams and is disposed so that its top surface is opposed to the light shielding members, and the luminous elements are organic EL elements disposed on the underside surface of the transparent substrate, which is preferable.

Third Embodiment

Figure 12:
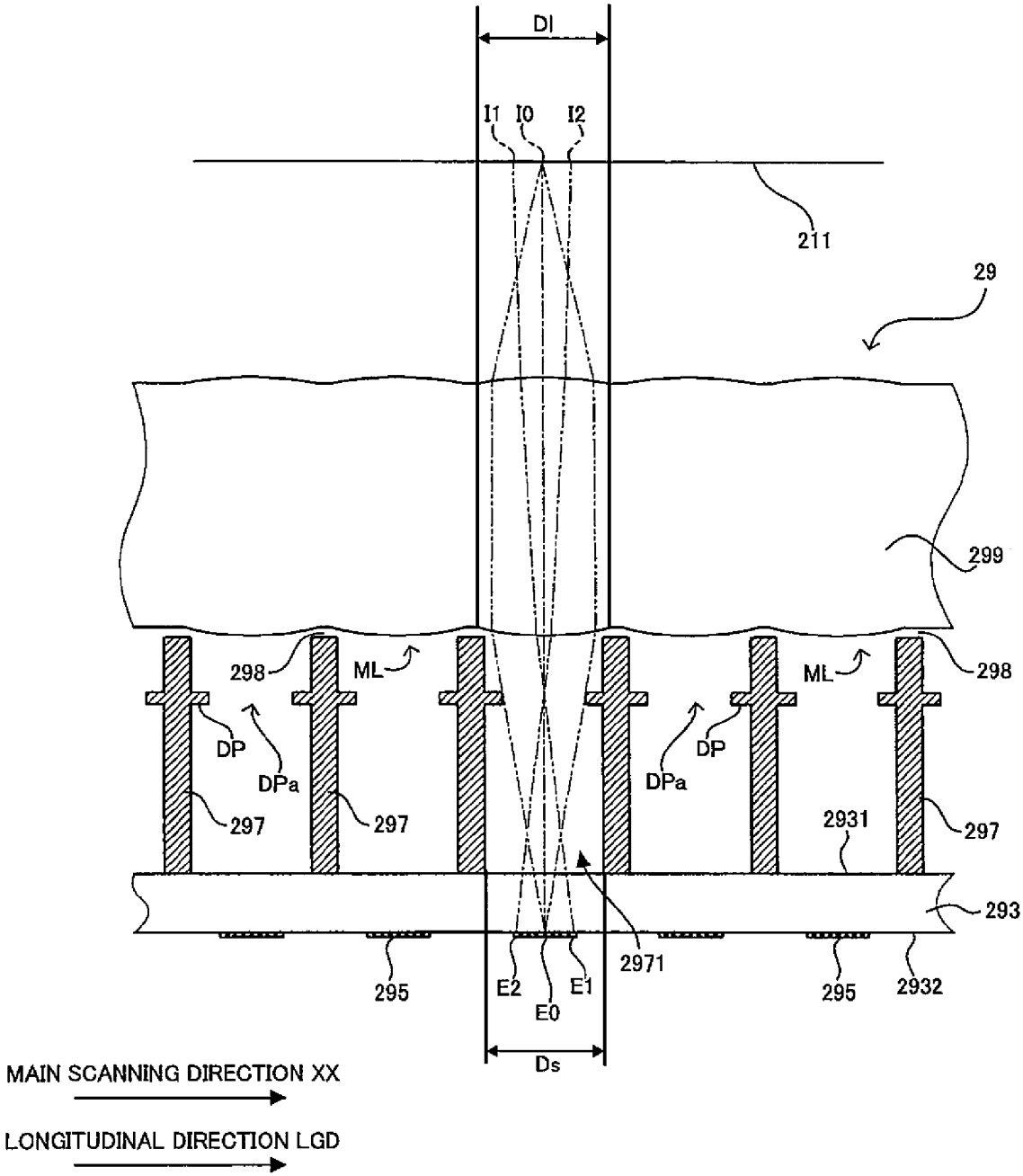
FIGS. 12 and 13 are cross sectional views of the line head in a third embodiment in the longitudinal direction which corresponds to the main scanning direction.
Figure 13:
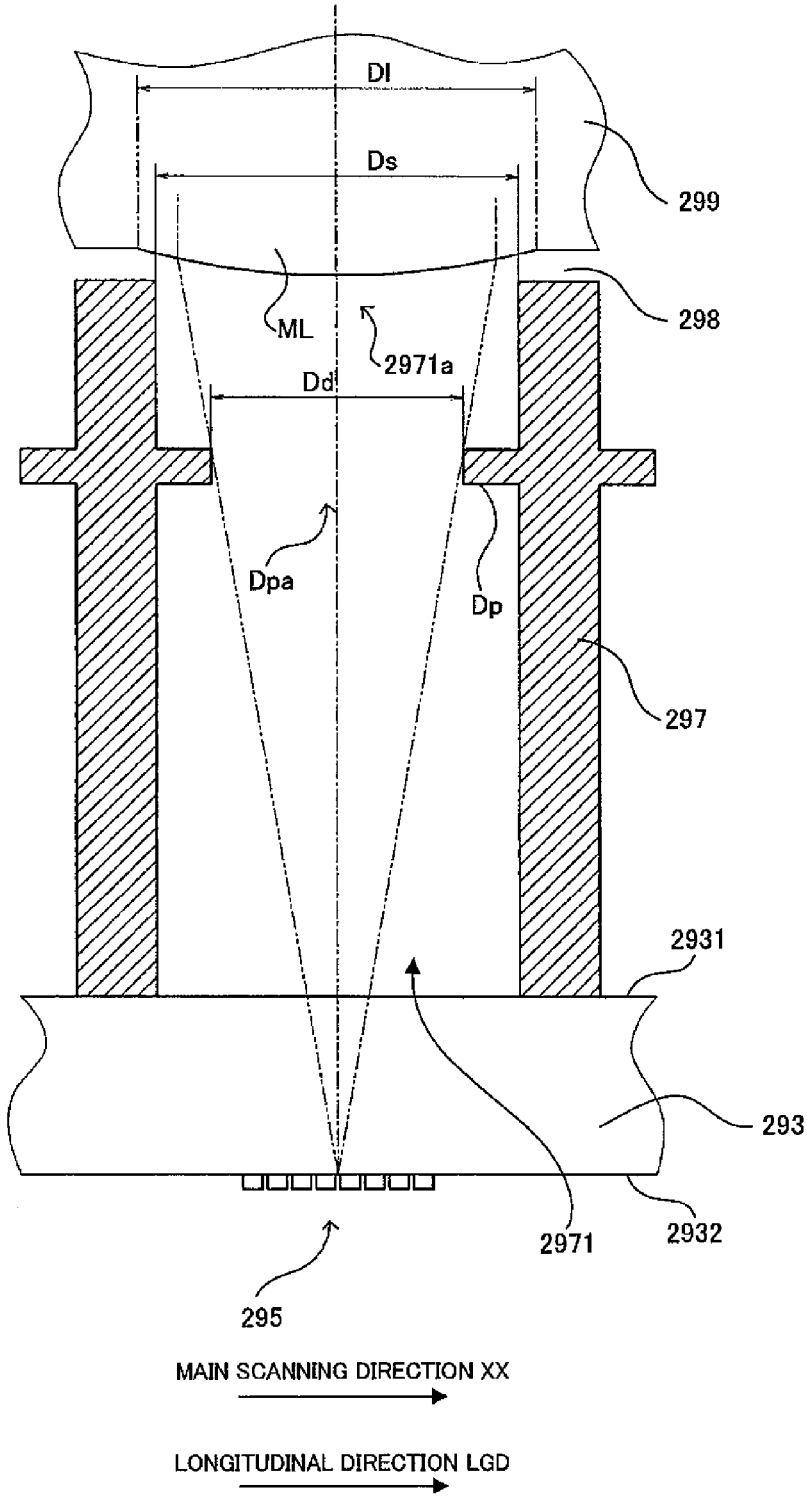

FIGS. 12 and 13 are cross sectional views of the line head 29 in a third embodiment in the longitudinal direction LGD which corresponds to the main scanning direction XX. Like the line head 29 described above, the line head 29 shown in FIGS. 12 and 13 comprises the glass substrate 293, the light shielding part 297 and the microlens array 299. The plural luminous element groups 295 are disposed on the underside surface 2932 of the glass substrate 293. Light beams emitted from the respective luminous element groups 295 propagate toward the top surface 2931 of the glass substrate 293 from the underside surface 2932 of the glass substrate 293.

The microlens array 299 is disposed so as to be opposed to the glass substrate 293 as viewed from the direction of propagation of light from the luminous element groups 295. The microlens array 299 comprises a plurality of microlenses ML.

The plurality of microlenses ML are disposed such that each microlens ML corresponds to each one of the plurality of luminous element groups 295.

The light shielding part 297 is disposed so that its one surface is opposed to the glass substrate 293 and its other surface is opposed to the microlens ML. At this stage, the light shielding part 297 abuts on the glass substrate 293 but stays spaced apart from the microlens array 299. To be more specific, the light shielding part 297 has the stepped portions 298 in its surface which is opposed to an area in which the microlens ML is disposed. The stepped portions 298 separate the microlens ML and the areas of the light shielding part 297 in which the light guiding holes 2971 opposed to the microlens ML are formed. The plural light guiding holes 2971 are provided in the light shielding part 297. The plural light guiding holes 2971 are disposed so that each light guiding hole 2971 corresponds to each one of the plural luminous element groups 295. That is, each one of the plural light guiding holes 2971 is perforated from the corresponding luminous element group 295 toward the microlens ML to which this luminous element group 295 corresponds. Hence, the light guiding holes 297 to which this luminous element group 295 corresponds guide the light beams emitted from the luminous element group 295 to the microlens ML to which the luminous element group 295 corresponds.

The line head 29 shown in FIGS. 12 and 13*c* is different from the line head 29 described above in the following aspects. To be more specific, the line head shown in FIGS. 12 and 13 comprises stop parts Dp inside the light guiding holes 2971. Stop apertures Dpa are formed in the stop parts Dp. The stop apertures Dpa are open to the microlens ML and also to the luminous element groups 295 as shown in FIGS. 12 and 13. Hence, some of light beams emitted from the luminous element groups 295 pass through the stop apertures Dpa and impinge upon the microlenses ML, while the other light beams get blocked by the stop parts Dp and fail to impinge upon the microlenses ML.

In FIG. 12, for representation of the imaging property of the microlens array 299, the dashed-dotted line denotes the trajectory of a principal ray of a light beam from the geometric center of gravity E0 of the luminous element group 295 and from the positions E1 and E2 which are separated by predetermined gaps from the geometric center of gravity E0. As the trajectory shows, the light beam from each position impinges upon the underside surface 2932 of the glass substrate 293 and thereafter leaves the top surface 2931 of the glass substrate 293. The light beams from the positions E0 through E2 all pass through the center of the stop aperture Dpa. Leaving the top surface 2931 of the glass substrate 293, the light beam reaches the surface 211 of the photosensitive drum 21 which is the surface-to-be-scanned via the microlens array 299.

The light beam from the geometric center of gravity E0 of the luminous element group 295 is imaged at the intersection I0 of the surface 211 of the photosensitive drum 21 and the optical axis OA of the microlens ML. This is because the geometric center of gravity E0 of the luminous element group 295 is on the optical axis OA of the microlens ML. Meanwhile, the light beams from the positions E1 and E2 are imaged respectively at positions I1 and I2 on the surface 211 of the photosensitive drum 21. To be more specific, the light beam from the position E1 is imaged at the position I1 which is on the opposite side to the optical axis OA of the microlens ML with respect to the main scanning direction XX, and the light beam from the position E2 is imaged at the position I2 which is on the opposite side to the optical axis OA of the microlens ML with respect to the main scanning direction XX. That is, the microlens ML is what is called an inverting optical system having an inverting property.

Further, a distance between the positions I1 and I0 at which the light beams are imaged is longer than a distance between the positions E1 and E0. That is, the absolute value of the magnification (optical magnification) of the above optical system in this embodiment is greater than 1. In other words, the above optical system in this embodiment is what is called a magnifying optical system having a magnifying property.

As shown in FIGS. 12 and 13, a longitudinal light guiding hole diameter Ds is smaller than a longitudinal lens diameter D1. At this stage, the longitudinal light guiding hole diameter Ds is the inner diameter of the light guiding holes 2951 in the longitudinal direction LGD. Further, the longitudinal lens diameter D1 is the bore diameter of the microlens ML in the longitudinal direction LGD. Hence, even when the relative position of the light shielding part 297 to the microlens ML shifts due to a temperature change, as shown in FIG. 14 described next, a situation that the light guiding holes 2971 move to outside the range of the bore diameter of the microlens ML is suppressed.

Figure 14:
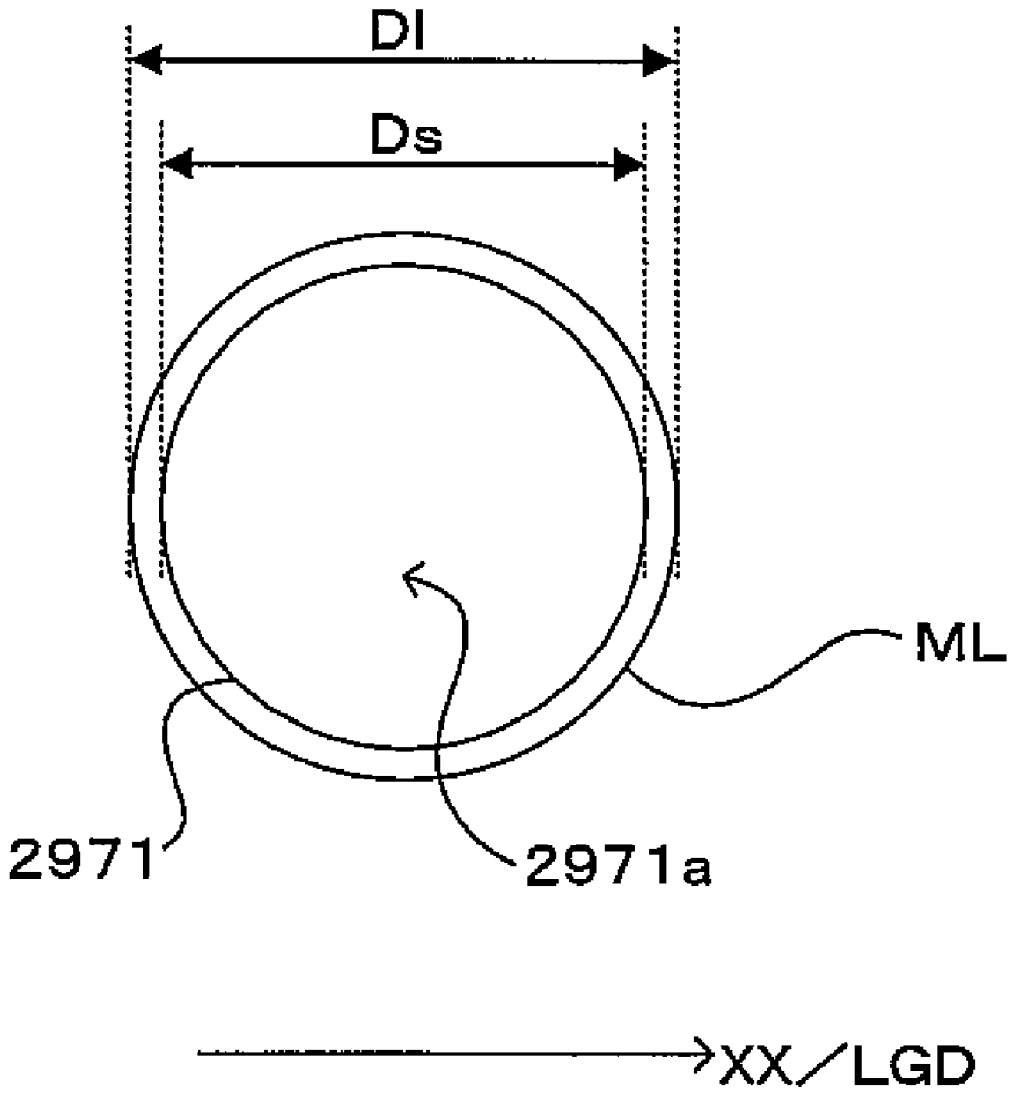
FIG. 14 is a diagram which shows a relationship between the locations of the light guiding hole and the microlens.

FIG. 14 is a diagram which shows a relationship between the locations of the light guiding hole 2971 and the microlens ML. The microlens ML and the light guiding hole 2971 are viewed from the direction of the optical axis OA of the microlens ML in FIG. 14. As shown in FIG. 14, since the longitudinal light guiding hole diameter Ds is smaller than the longitudinal lens diameter D1, the light guiding hole 2971 is within the range of the bore diameter of the microlens ML. The situation herein referred to that the light guiding hole 2971 is within the range of the bore diameter of the microlens ML is a situation that lens-side aperture part 2971*a* of the light guiding hole 2971, as viewed from the direction of the optical axis of the microlens ML, is entirely inside the microlens ML.

The light beams passing through the light guiding holes 2971 are guided to the microlens ML which corresponds to the light guiding holes 2971. That is, a problem is suppressed that light beams emitted from the luminous element groups 295 are incident upon other positions than the microlens ML corresponding to the luminous element groups 295 and ghosts are generated. Hence, it is possible according to the embodiment shown in FIGS. 12 and 13 to form favorable spots even when the relative position of the light shielding part 297 to the microlenses ML shifts due to a temperature change. Further, as the description on the effect according to this embodiment illustrated in FIG. 14 indicates, the longitudinal light guiding hole diameter Ds is the inner diameter of the lens-side aperture parts 2971*a* of the light guiding holes 2971 taken in the longitudinal direction LGD.

Further, according to the embodiment shown in FIGS. 12 and 13, the light shielding part 297 includes, inside the light guiding holes 2971, the stop parts Dp which are bored in the stop apertures Dpa which transmit some of light beams which propagate toward the microlenses ML corresponding to the light guiding holes 2971 from the luminous element groups 295 corresponding to the light guiding holes 2971. Hence, light beams incident upon the microlenses ML among light beams emitted from the luminous element groups 295 are light beams which pass through the stop apertures Dpa which are formed in the stop parts Dp. That is, utilizing the stop parts Dp, the embodiment shown in FIGS. 12 and 13 suppresses incidence of unwanted light beams upon the microlenses ML.

A longitudinal stop aperture diameter Dd is smaller than the longitudinal light guiding hole diameter Ds and the longitudinal light guiding hole diameter Ds is smaller than the longitudinal lens diameter D1. At this stage, the longitudinal stop aperture diameter Dd is the inner diameter of the stop apertures Dpa taken in the longitudinal direction LGD. Hence, even when the relative positions of the luminous element groups 295 to the stop parts Dp corresponding to the luminous element groups 295 shift in the longitudinal direction LGD and stray light is generated because of a difference in terms of thermal expansion and contraction between the glass substrate 293 and the light shielding part 297 caused by a temperature change, incidence of the stray light upon the microlenses ML is suppressed.

As described above, the longitudinal light guiding hole diameter Ds is smaller than the longitudinal lens diameter D1. Hence, even despite shift of the relative positions of the light shielding part 297 to the microlenses ML owing to a temperature change, this suppresses a situation that the light guiding holes 2971 move to outside the range of the bore diameter of the microlenses ML. In spite of stray light therefore, the light guiding holes 2971 which are within the range of the bore diameter of the microlenses ML block the stray light before the stray light reaches the microlenses ML.

Figure 15:
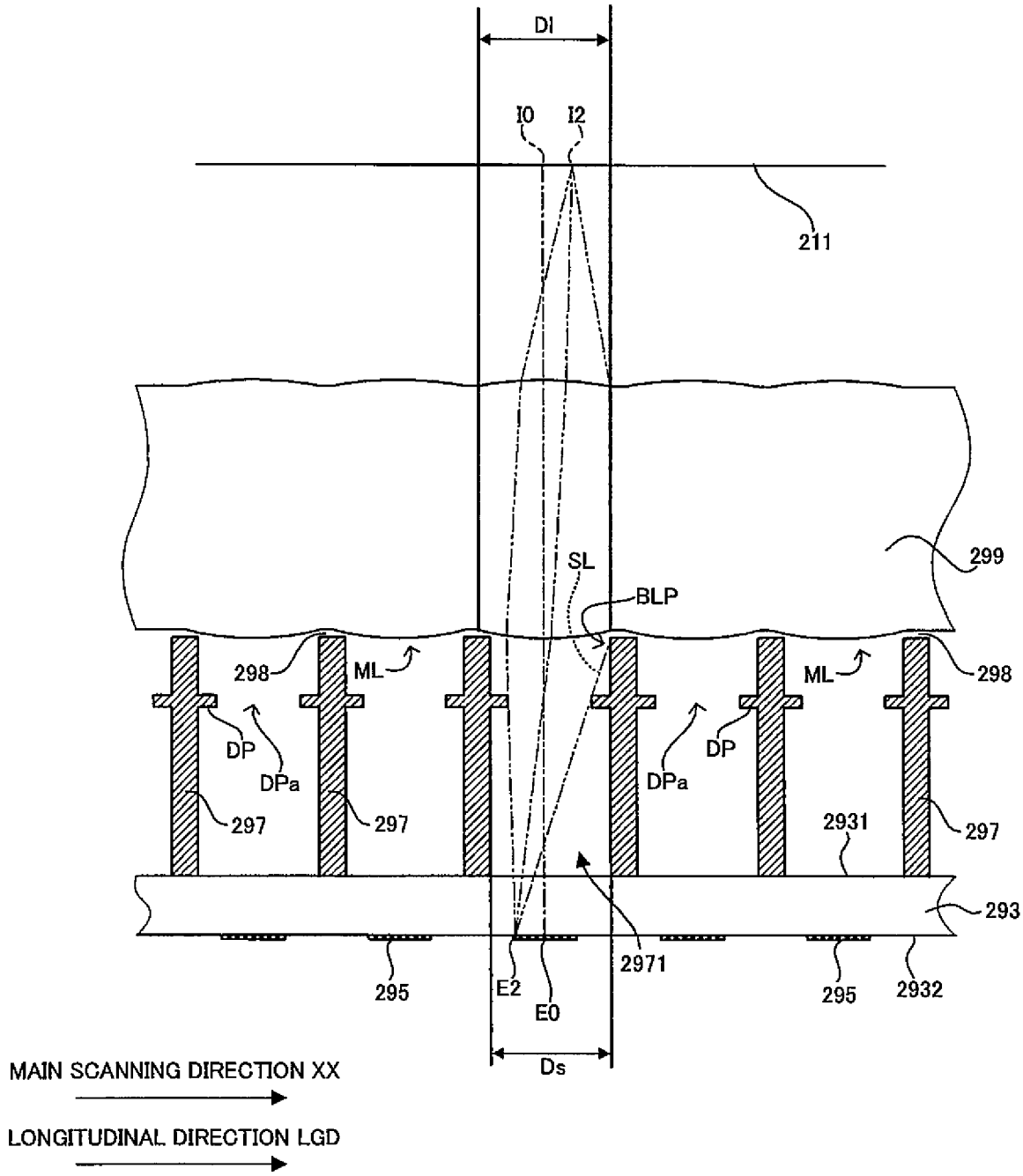
FIG. 15 is a diagram which shows suppressed incidence of stray light upon the microlenses.

FIG. 15 is a diagram which shows suppressed incidence of stray light upon the microlenses ML. That is, illustrated in FIG. 15 is generation of a difference in terms of thermal expansion and contraction between the glass substrate 293 and the light shielding part 297 caused by a temperature change. Due to the difference in terms of thermal expansion and contraction, in FIG. 15, the luminous element groups 295 are shifted leftward in FIG. 15 with respect to the light guiding holes 2971 (that is, toward the opposite direction to the longitudinal direction LGD denoted at the arrow). In consequence, a light beam emitted from the luminous element 2951 located at the position E2 partially becomes stray light SL which passes through the stop aperture Dpa in FIG. 15. However, since the longitudinal light guiding hole diameter Ds is smaller than the longitudinal lens diameter D1, the light guiding hole 2971 blocks propagation of the stray light SL before the stray light SL reaches the microlens ML. Specifically, as shown in FIG. 15, the stray light SL impinges upon a position BLP at the top of the inner wall of the light guiding hole 2971 and any further propagation is blocked. Generation of a ghost attributable to incidence of the stray light SL upon the microlens ML is thus suppressed. The stray light SL herein referred to is light beams which have passed through the stop apertures Dpa because of dislocation of the luminous element groups 295 relative to the light guiding holes 2971 corresponding to the luminous element groups 295 among light beams which will not pass through the stop apertures Dpa but for the dislocation of the luminous element groups 295 relative to the light guiding holes 2971 corresponding to the luminous element groups 295.

By the way, in the embodiment shown in FIGS. 12 and 13 as well, the light shielding part 297 or the light shielding members 297A and 297B (the light shielding parts 297 and the like) are preferably fixed in the central portions to the microlens array 299 as shown FIG. 8 or 11. That is, where the light shielding part 297 and the like is fixed at a predetermined fixing position to the microlens array 299, shift of the relative position of the light shielding part 297 and the like to the microlens array 299 is suppressed small regardless of a temperature change in the vicinity of the fixing position of the light shielding part 297 and the like. Meanwhile, there is a tendency that with a distance away from the fixing position in the longitudinal direction LGD, shift of the relative position of the light shielding part 297 and the like to the microlens array 299 increases. Hence, it is preferable that the fixing position is set so as to shorten a distance (maximum distance) between the fixing position and the farthest one among the positions in the light shielding part 297 and the like from the fixing position.

The central portion of the light shielding part 297 is as follows. First, of the plural light guiding holes 2971 formed in the light shielding part 297, a one-end light guiding hole is the light guiding hole 2971 located at one end of the longitudinal direction LGD which corresponds to the main scanning direction XX, and an other-end light guiding hole is the light guiding hole 2971 located at the other end in the longitudinal direction LGD. The central portion is a portion of the light shielding part located in the middle in the longitudinal direction LGD between the optical axis OA1 of a microlens 1 which corresponds to the one-end light guiding hole and the optical axis OA2 of a microlens 2 which corresponds to the other-end light guiding hole.

In addition, the central portion of the light shielding member 297A is as follows. First, of the plural light guiding holes 2971 formed in the light shielding member 297A, the one-end light guiding hole is the light guiding hole 2971 located at one end of the longitudinal direction LGD which corresponds to the main scanning direction XX, and the other-end light guiding hole is the light guiding hole 2971 located at the other end in the longitudinal direction LGD. The "central portion of the light shielding member 297A" is a portion of the light shielding member 297A located in the middle in the longitudinal direction LGD between the optical axis OAa1 of a microlens a1 which corresponds to the one-end light guiding hole and the optical axis OAa2 of a microlens a2 which corresponds to the other-end light guiding hole. Further, the central portion of the light shielding member 297B is similar.

As shown in FIG. 8 or 11, it is preferable that the light shielding part 297 and the like is fixed in the central portion to the microlens array 299, that is, that the central portion is the fixing position. In this structure, the fixing position is an approximately central portion of the light shielding part 297 and the like and the above maximum distance is about half the longitudinal length of the light shielding part 297 and the like. In other words, this structure is preferable since it shortens the maximum distance more than where the fixing position is the end of the line head 29 in the longitudinal direction and the maximum distance is approximately equal to the longitudinal length of the light shielding part 297 and the like. Further, since the light shielding part 297 and the like is fixed in the central portion and the like in this structure, the relative position of the light shielding part 297 and the like to the microlens array 299 shifts approximately symmetrically with respect to the central portion and the like in the longitudinal direction LGD. This equalizes and suppresses the shift of the relative position all over the light shielding part 297 and the like, which in turn suppresses generation of ghosts and makes it possible to favorably form spots.

In the embodiment shown in FIGS. 12 and 13 as well, it is preferable that the line head is formed so as to satisfy Formula 1 described above or Formula 2 and Formula 3. The reason will now be described.

Figure 16:
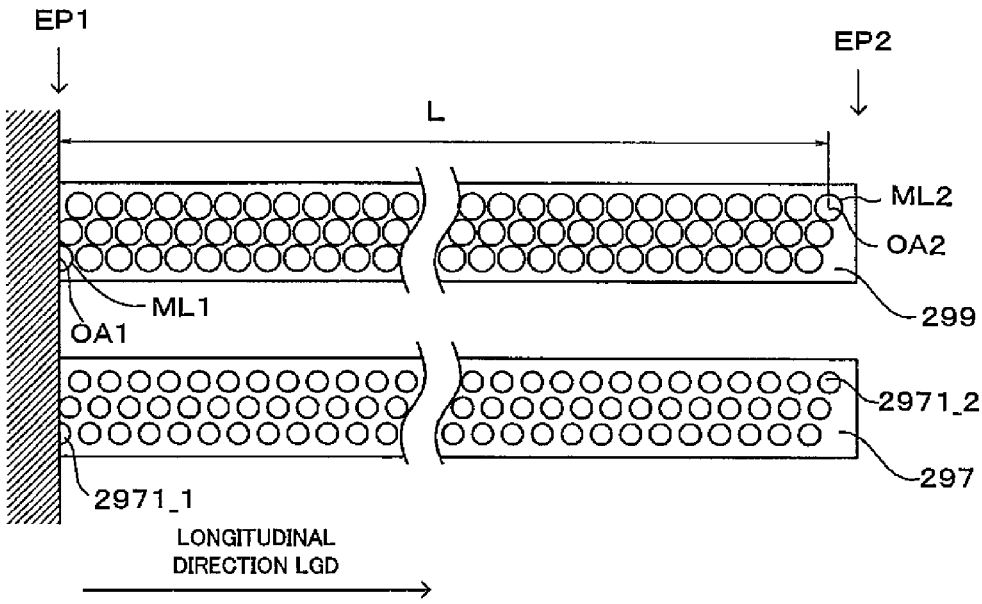
FIGS. 16 and 17 are explanatory diagrams for describing the effect which is obtainable when Formula 1 is satisfied.
Figure 17:
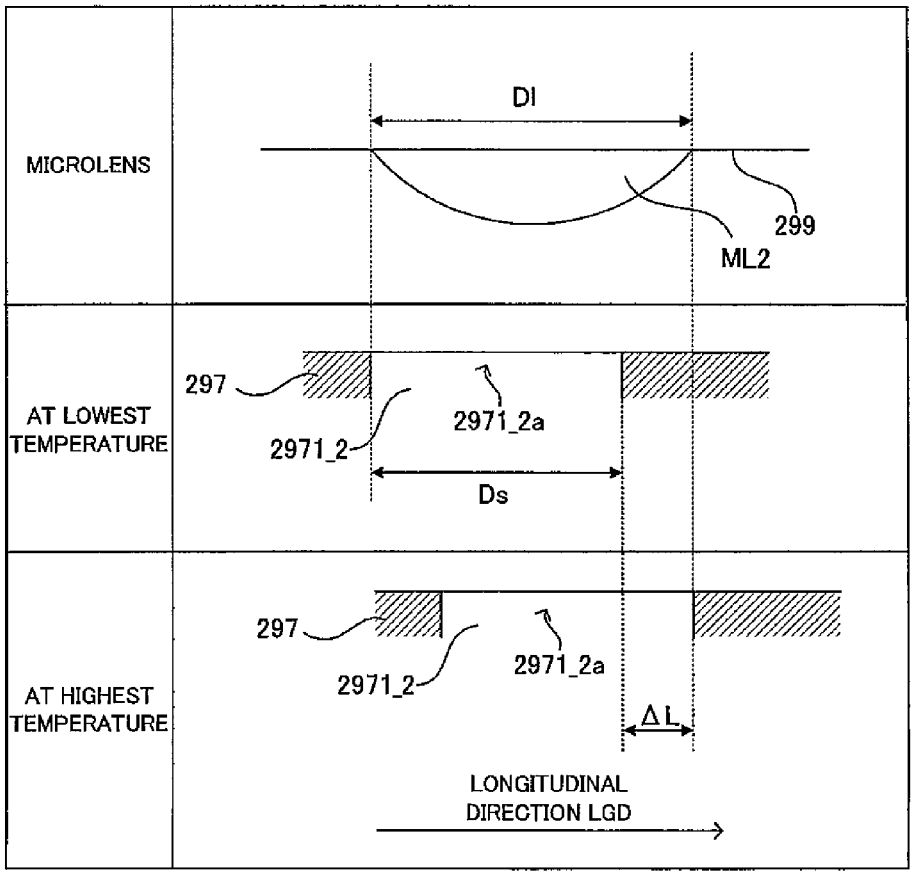

FIGS. 16 and 17 are explanatory diagrams for describing the effect which is obtainable when Formula 1 is satisfied. To illustrate correlation between the microlens array 299 and the light shielding part 297, the microlens array 299 and the light shielding part 297 are shown side by side in FIG. 16. That is, it is for the convenience of description that FIG. 16 shows the microlens array 299 and the light shielding part 297 side by side, and in reality, as described above, the microlens array 299 and the light shielding part 297 are stacked one atop the other and fixed to each other as such. Specifically, the assumption in FIGS. 16 and 17 is that the microlens array 299 and the light shielding part 297 are fixed to each other at one end EP1 in the longitudinal direction LGD. That is, the assumption in FIGS. 16 and 17 is the worst as the microlens array 299 and the light shielding part 297 are fixed to each other at the most disadvantageous location considering relative deviation between the microlenses ML and the light guiding holes 2971. Further, in FIG. 16, of the plural light guiding holes 2971 formed in the light shielding part 297, the one-end light guiding hole at one end in the longitudinal direction LGD is denoted at the symbol 2971_1 and the other-end light guiding hole at the other end in the longitudinal direction LGD is denoted at the symbol 2971_2. In FIG. 16, the distance L is a distance in the longitudinal direction LGD between the optical axis OA1 of the microlens ML which corresponds to the one-end light guiding hole 2971_1 and the optical axis OA2 of the microlens ML which corresponds to the other-end light guiding hole 2971_2.

In the event that the light shielding part 297 is fixed to the microlens array 299 at one end EP1 in this manner, it is the other end EP2 that finds the greatest amount of movement in the longitudinal direction LGD owing to thermal expansion and contraction. A discussion will now be given on a condition under which the other-end light guiding hole 2971_2 closest to the other end EP2 stays in the range of the microlens ML which corresponds to the other-end light guiding hole 2971_2 within the temperature range in use T. That is, a discussion will be given on a condition under which the lens-side aperture part 2971_2*a* of the other-end light guiding hole 2971_2 stays in the range of a microlens ML2 at both the lowest temperature and the highest temperature within the temperature range in use T.

In FIG. 17, the "MICROLENS" section shows the microlens ML2 which corresponds to the light guiding hole 2971_2, the "AT LOWEST TEMPERATURE" section shows the relative position of the light guiding hole 2971_2 to the microlens ML2 at the lowest temperature, and the "AT HIGHEST TEMPERATURE" section shows the relative position of the light guiding hole 2971_2 to the microlens ML2 at the highest temperature. That is, as the temperature rises, the light guiding hole 2971_2 moves in the arrow which represents the longitudinal direction LGD in FIG. 17. The amount of movement of the microlens ML2 in the longitudinal direction LGD upon a change from the lowest temperature to the highest temperature is $\alpha m \cdot L \cdot T$, while the amount of movement of the light guiding hole 2971_2 is $\alpha s \cdot L \cdot T$. The linear expansion coefficient $\alpha m$ is the linear expansion coefficient of the microlens array 299 in the longitudinal direction LGD, and the linear expansion coefficient $\alpha s$ is the linear expansion coefficient of the light shielding part 297 in the longitudinal direction LGD. Therefore, the amount of movement $\Delta L$ of the light guiding hole 2971_2 relative to the microlens ML2 is expressed by the formula below:

$$\Delta L = (\alpha s - \alpha m) \cdot L \cdot T$$

As shown in FIG. 17, for the inner diameter of the light guiding hole 2971_2 (namely, the inner diameter of the lens-side aperture part 2971_2*a* of the other-end light guiding hole 2971_2) to stay within the bore diameter of the microlens ML even despite movement of the light shielding part 297 relative to the microlens array 299, the inner diameter Ds of the light guiding hole 2971_2 may be smaller than a value which is calculated by subtracting the amount of movement $\Delta L$ from the bore diameter D1 of the microlens ML2. Hence, as the line head 29 is formed so as to satisfy Formula 1, namely, the formula below, it is possible to discourage occurrence of a situation that the light guiding holes 2971 move to outside the range of the bore diameter of the microlenses ML within the temperature range in use T:

$$D1 - (\alpha s - \alpha m) \cdot L \cdot T \geqq Ds$$

This suppresses a problem that light beams emitted from the luminous element groups 295 are incident upon other positions than the microlenses ML corresponding to the luminous element groups 295 and ghosts are generated, and reduce generation of ghosts attributable to incidence of the stray light SL upon the microlenses ML.

By the way, although each light shielding part 297 is formed by the two members, that is, the light shielding member 297A and the light shielding member 297B in the embodiment shown in FIG. 11, it may be formed by three or more members. When formed by more members, the light shielding part 297 can better decrease shift of the relative positions. Further, the clearance 2975 may have any shape.

In essence, the line head or the image forming apparatus according to the third embodiment comprises the lens array comprising the plural imaging lenses which are disposed so that each imaging lens corresponds to each one of the plural luminous element groups and the light shielding part which includes the plural light guiding holes which are disposed so that each light guiding hole corresponds to each one of the plural luminous element groups. Each light guiding hole extends from the luminous element group to which the light guiding hole corresponds toward the imaging lens to which the light guiding hole corresponds. Hence, light beams emitted from the luminous elements belonging to the luminous element groups impinge, via the light guiding holes which correspond to the luminous element groups, upon the imaging lenses which correspond to these luminous element groups.

The longitudinal light guiding hole diameter Ds is smaller than the longitudinal lens diameter D1. As described earlier, the longitudinal light guiding hole diameter Ds is the inner diameter of the light guiding holes taken in the longitudinal direction, and the longitudinal lens diameter D1 is the bore diameter of the imaging lenses taken in the longitudinal direction. This makes it possible to discourage occurrence of a situation that the light guiding holes move to outside the range of the bore diameter of the imaging lenses even despite shift of the relative positions of the light shielding part and the imaging lenses due to a temperature change. The light beams passing through the light guiding holes are thus guided to the imaging lenses which correspond to the light guiding holes. This in other words suppresses a problem that the light beams emitted from the luminous element groups are incident upon other positions than the imaging lenses corresponding to the luminous element groups and ghosts are generated. According to the third embodiment therefore, it is possible to favorably form spots even despite shift of the relative position of the light shielding part to the imaging lenses due to a temperature change.

Further, according to the third embodiment, the light shielding part comprises, for the respective light guiding holes, the stop parts which include the stop apertures which transmit some light beams to the imaging lenses corresponding to the light guiding holes among light beams which are incident upon the light guiding holes. Those light beams impinging upon the imaging lenses among the light beams emitted from the luminous element groups are the light beams which pass through the stop apertures of the stop parts. In short, utilizing the stop parts, the invention suppresses incidence of unwanted light beams upon the imaging lenses.

The longitudinal stop aperture diameter Dd is smaller than the longitudinal light guiding hole diameter Ds, and the longitudinal light guiding hole diameter Ds is smaller than the longitudinal lens diameter D1. The longitudinal stop aperture diameter Dd is the inner diameter of the stop apertures taken in the longitudinal direction. Hence, even when the relative positions of the luminous element groups to the stop apertures corresponding to the luminous element groups shift in the longitudinal direction and stray light is generated because of a difference in terms of thermal expansion and contraction between the substrate and the light shielding part caused by a temperature change, incidence of the stray light upon the imaging lenses is suppressed.

That is, according to the third embodiment, the longitudinal light guiding hole diameter Ds is smaller than the longitudinal lens diameter D1. Hence, even despite of shift of the relative position of the light shielding part to the imaging lenses due to a temperature change, occurrence of a situation that the light guiding holes move to outside the range of the bore diameter of the imaging lenses is discouraged. Even though stray light is generated therefore, the stray light is blocked by the light guiding holes which are within the range of the bore diameter of the imaging lenses before it reaches the imaging lenses. The third embodiment consequently suppresses generation of ghosts attributable to incidence of the stray light upon the imaging lenses.

Further, the third embodiment is preferable as the line head is structured so that the light shielding part is formed by one or plural light shielding members, the plural light guiding holes are disposed in the light shielding members, and assuming that among the plural light guiding holes which are provided in the light shielding members, the one hole at one end in the longitudinal direction is defined as the one-end light guiding hole and the one hole at the other end in the longitudinal direction is defined as the other-end light guiding hole, the distance L in the longitudinal direction between the optical axis of the imaging lens which corresponds to the one-end light guiding hole and the optical axis of the imaging lens which corresponds to the other-end light guiding hole, the linear expansion coefficient am of the lens array in the longitudinal direction, the linear expansion coefficient as of the light shielding members in the longitudinal direction, the temperature range in use T, the longitudinal light guiding hole diameter Ds and the longitudinal lens diameter D1 satisfy the formula below in the line head:

$$D1-(\alpha s-\alpha m)\cdot L\cdot T\geqq Ds$$

In the case where the line head is structured to satisfy the formula above, within the temperature range in use, the longitudinal light guiding hole diameter Ds is smaller than the longitudinal lens diameter D1. In addition, even when the temperature changes within the temperature range in use and the relative position of the light shielding part to the imaging lenses consequently shifts, occurrence of a situation that the light guiding holes move to outside the range of the bore diameter of the imaging lenses is discouraged. This suppresses a problem that light beams emitted from the luminous element groups are incident upon other positions than the imaging lenses corresponding to the luminous element groups and ghosts are generated, and suppresses generation of ghosts attributable to incidence of stray light upon the imaging lenses.

Further, the third embodiment is preferable as it requires forming the line head in which the light shielding member is fixed to the lens array in its central portion where a portion of the light shielding member located in the middle in the longitudinal direction between the optical axis of the imaging lens which corresponds to the one-end light guiding hole and the optical axis of the imaging lens which corresponds to the other-end light guiding hole is defined as the central portion of the light shielding member.

In other words, when the light shielding members are fixed at predetermined fixing positions to the lens array, shift of the relative positions of the light shielding members to the lens array is suppressed in the vicinity of the fixing positions of the light shielding members independently of a temperature change. Meanwhile, there is a tendency that with a distance away from the fixing positions in the longitudinal direction, shift of the relative positions of the light shielding members to the lens array increases. It is therefore preferable that the fixing positions are set so as to shorten a distance (maximum distance) between the fixing positions and the farthest one among the positions in the light shielding members from the fixing positions.

For this reason, fixing of the light shielding members at the central portions to the lens array, namely, using the central portions as the fixing positions is preferable as described above. In this structure, the fixing positions are approximately at the center of the light shielding members in the longitudinal direction and the maximum distance is approximately half the longitudinal length of the light shielding members. In short, the maximum distance is shorter in this structure than in the case where for example the fixing positions are at the ends of the line head in the longitudinal direction so that the maximum distance is approximately equal to the longitudinal length of the light shielding members, and therefore, this structure is preferable. Further, since the light shielding members are fixed at the central portions in this structure, the relative positions of the light shielding members to the lens array shift approximately symmetrically with respect to the central portions in the longitudinal direction. This equalizes and suppresses the shift of the relative positions all across the light shielding members, which in turn suppresses generation of ghosts and makes it possible to favorably form spots.

Thus, in the embodiment described above, the longitudinal direction LGD corresponds to the "first direction" of the invention, the longitudinal light guiding hole diameter Ds corresponds to the "first light guiding hole diameter (Ds)" of the invention, the longitudinal lens diameter D1 corresponds to the "first lens diameter" of the invention, and the longitudinal stop aperture diameter Dd corresponds to the "first stop aperture diameter" of the invention.

Fourth Embodiment

Figure 18:
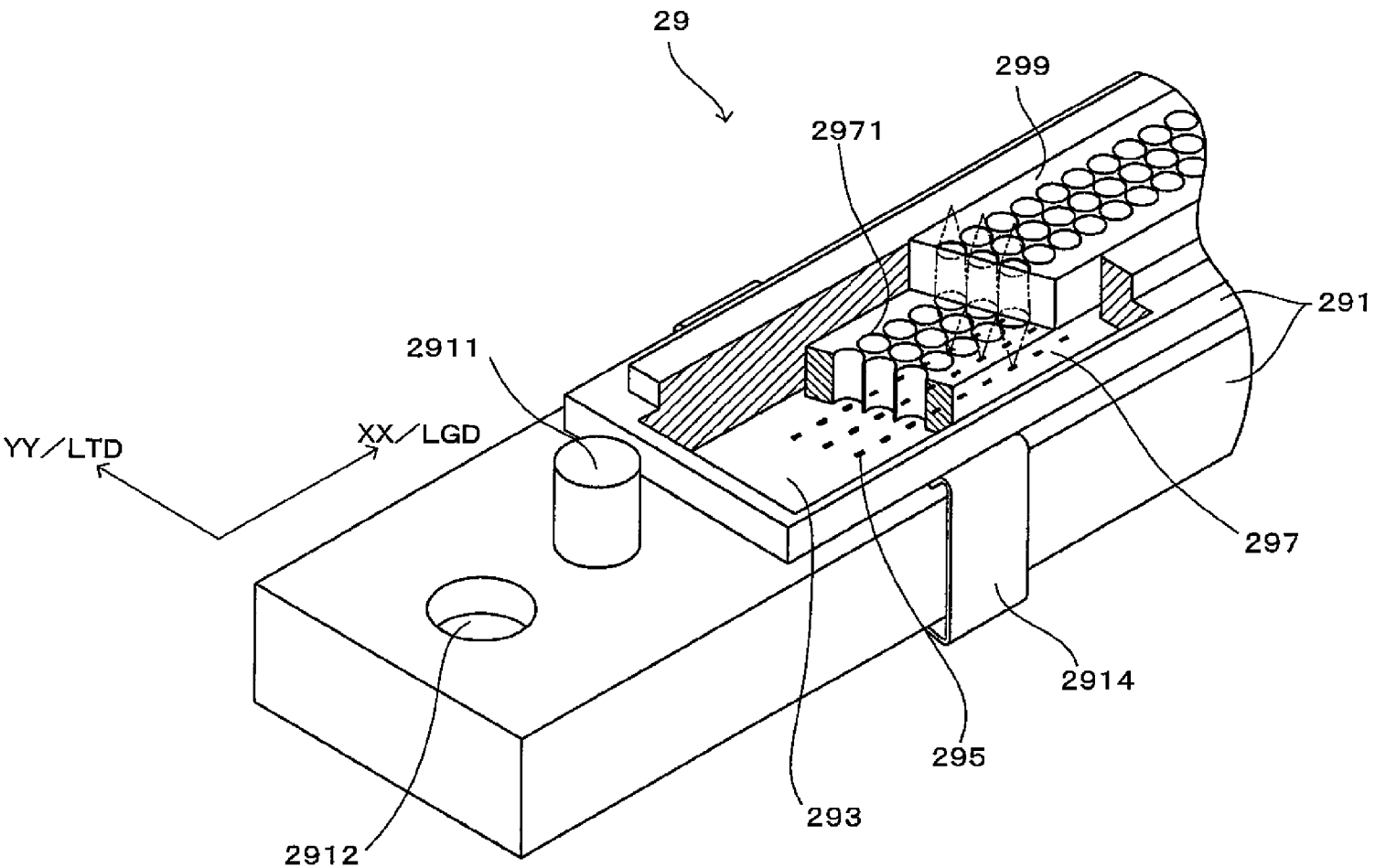
FIG. 18 is a perspective view schematically showing a fourth embodiment of the line head according to the invention.
Figure 19:
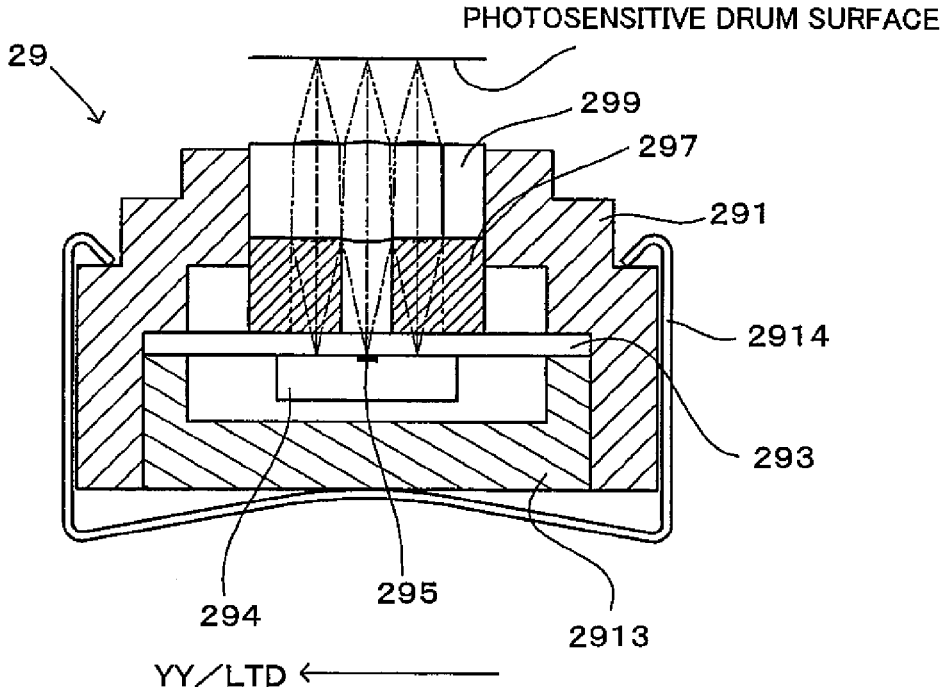
FIG. 19 is a sectional view of the fourth embodiment of the line head according to the invention in the width direction which corresponds to the sub scanning direction.

FIG. 18 is a perspective view schematically showing a fourth embodiment of the line head (exposure section) according to the invention, and FIG. 19 is a sectional view of the fourth embodiment of the line head (exposure section) according to the invention in the width direction which corresponds to the sub scanning direction. The line head 29 according to the fourth embodiment includes a case 291 of which the longitudinal direction is parallel to the main scanning direction XX. A positioning pin 2911 and a screw insertion hole 2912 are provided at each of the opposite ends of the case 291. The line head 29 is positioned with respect to the photosensitive drum 21 by fitting the positioning pins 2911 into positioning holes (not shown) formed in a photosensitive drum cover (not shown) covering the photosensitive drum 21. Further, the line head 29 is fixed with respect to the photosensitive drum 21 by screwing fixing screws into screw holes (not shown) of the photosensitive drum cover through the screw insertion holes 2912. That is, the line head 29 is arranged such that the longitudinal direction LGD of the line head 29 corresponds to the main scanning direction XX, and that the width direction LTD of the line head 29 corresponds to the sub scanning direction YY.

The case 291 carries a microlens array 299 at a position facing the surface of the photosensitive drum 21, and includes, inside thereof, a light shielding part 297 and a glass substrate 293 in this order from the microlens array 299. A plurality of luminous element groups 295 are arranged on the underside surface of the glass substrate 293 (surface opposite to the one where the microlens array 299 is disposed out of two surfaces of the glass substrate 293). Specifically, the plurality of luminous element groups 295 are two-dimensionally arranged on the underside of the glass substrate 293 while being spaced apart at specified intervals from each other in the main scanning direction XX and in a sub scanning direction YY. Here, each of the plurality of luminous element groups 295 is composed of a plurality of two-dimensionally arranged luminous elements. In the fourth embodiment, an organic EL (electroluminescence) device is used as the luminous element. In other words, the organic EL devices are arranged on the underside surface of the glass substrate 293 as the luminous elements. The light beams emitted from of the respective plurality of the luminous elements in a direction toward the photosensitive drum 21 are headed for the light shielding part 297 via the glass substrate 293.

The light shielding part 297 is formed with a plurality of light guiding holes 2971 which are in a one-to-one correspondence with the plurality of luminous element groups 295. Each of the light guiding holes 2971 is in the form of a substantial cylinder whose central axis is parallel to a normal line to the surface of the glass substrate 293, and penetrates the light shielding part 297. That is, the light beam emitted from the luminous element 2951 belonging to a luminous element group 295 is guided to the microlens array 299 by means of the light guiding hole 2971 which corresponds to the luminous element group 295. The light beams having passed through the light guiding holes 2971 formed in the light shielding part 297 are focused as spots on the surface of the photosensitive drum 21 by means of the microlens array 299.

As shown in FIG. 19, an underside lid 2913 is pressed to the case 291 via the glass substrate 293 by a retainer 2914. Specifically, the retainer 2914 has an elastic force to press the underside lid 2913 toward the case 291, and seals the inside of the case 291 light-tight (that is, so that light does not leak from the inside of the case 291 and so that light does not intrude into the case 291 from the outside) by pressing the underside lid 2913 by means of the elastic force. It should be noted that a plurality of the retainers 2914 are provided at a plurality of positions in the longitudinal direction of the case 291. The luminous element groups 295 are covered with a sealing member 294.

Figure 20:
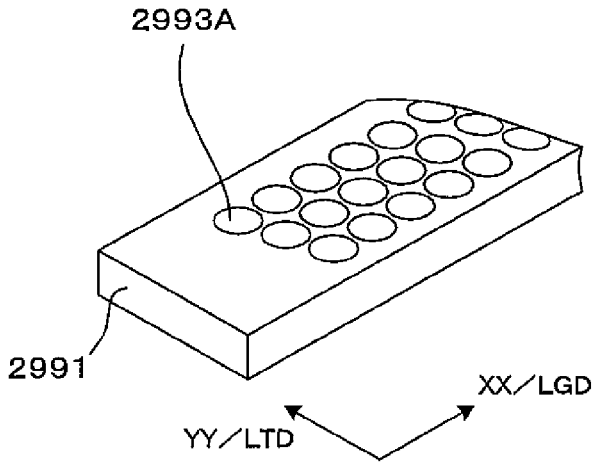
FIG. 20 is a perspective view schematically showing the microlens array.
Figure 21:
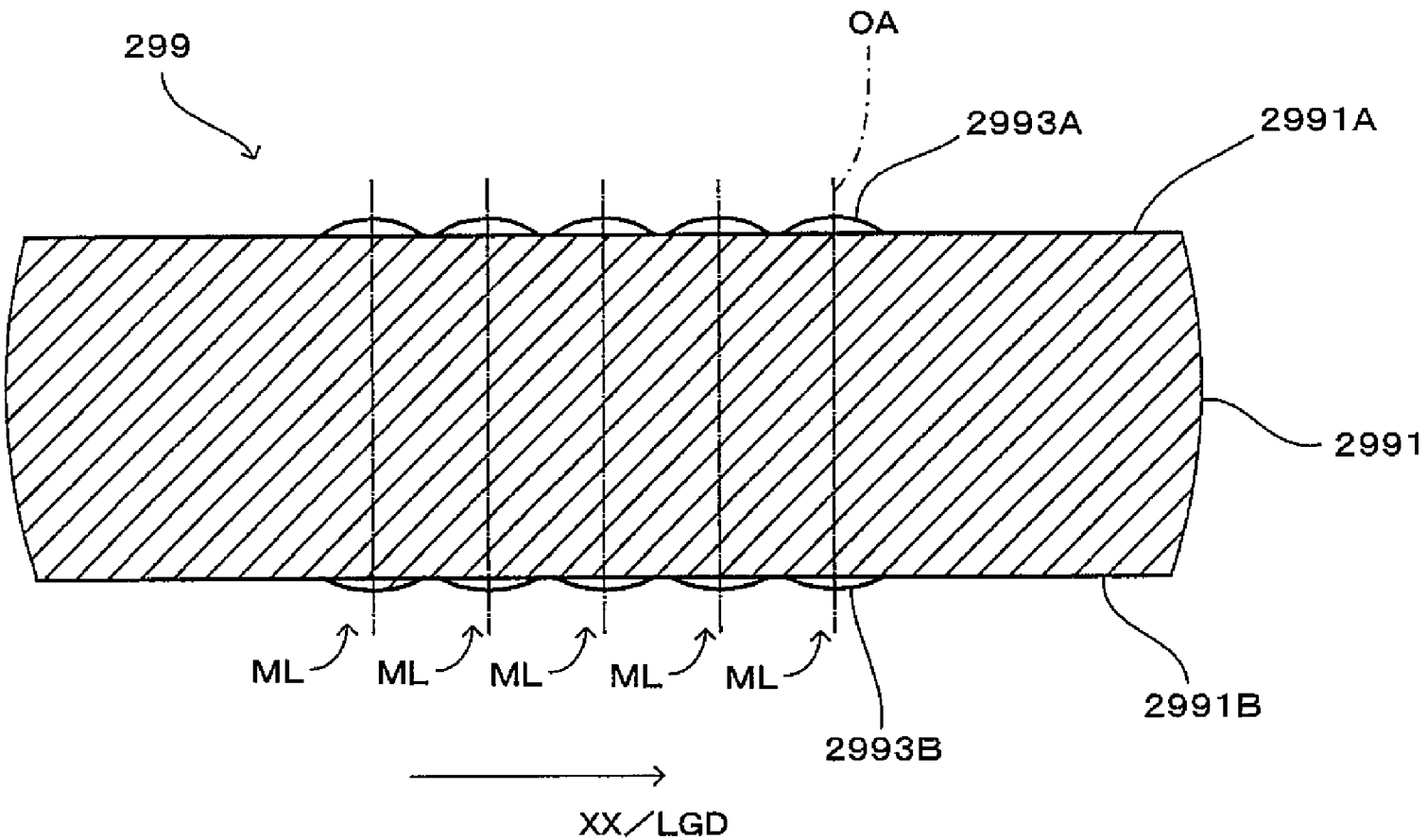
FIG. 21 is a sectional view of the microlens array in the longitudinal direction which corresponds to the main scanning direction.

FIG. 20 is a perspective view schematically showing the microlens array, and FIG. 21 is a sectional view of the microlens array in the longitudinal direction which corresponds to the main scanning direction. The microlens array 299 includes a glass substrate 2991 and a plurality of lens pairs each comprised of two lenses 2993A and 2993B which are arranged in a one-to-one correspondence at the opposite sides of the glass substrate 2991. Meanwhile, these lenses 2993A and 2993B can be made of resin.

Specifically, a plurality of lenses 2993A are arranged on a top surface 2991A of the glass substrate 2991, and a plurality of lenses 2993B are so arranged on an underside surface 2991B of the glass substrate 2991 as to correspond one-to-one to the plurality of lenses 2993A. Further, two lenses 2993A and 2993B constituting a lens pair have a common optical axis OA. These plurality of lens pairs are arranged in a one-to-one correspondence with the plurality of luminous element groups 295. Meanwhile, in this specification, an optical system which includes lenses 2993A and 2993B constituting a pair of one to one and the glass substrate 2991 located between the lens pair is called "microlens ML". These plurality of lens pairs (microlenses ML) are two-dimensionally arranged and spaced apart from each other at specified intervals in the main scanning direction XX and the sub scanning direction YY corresponding to the arrangement of the luminous element groups 295.

Figure 22:
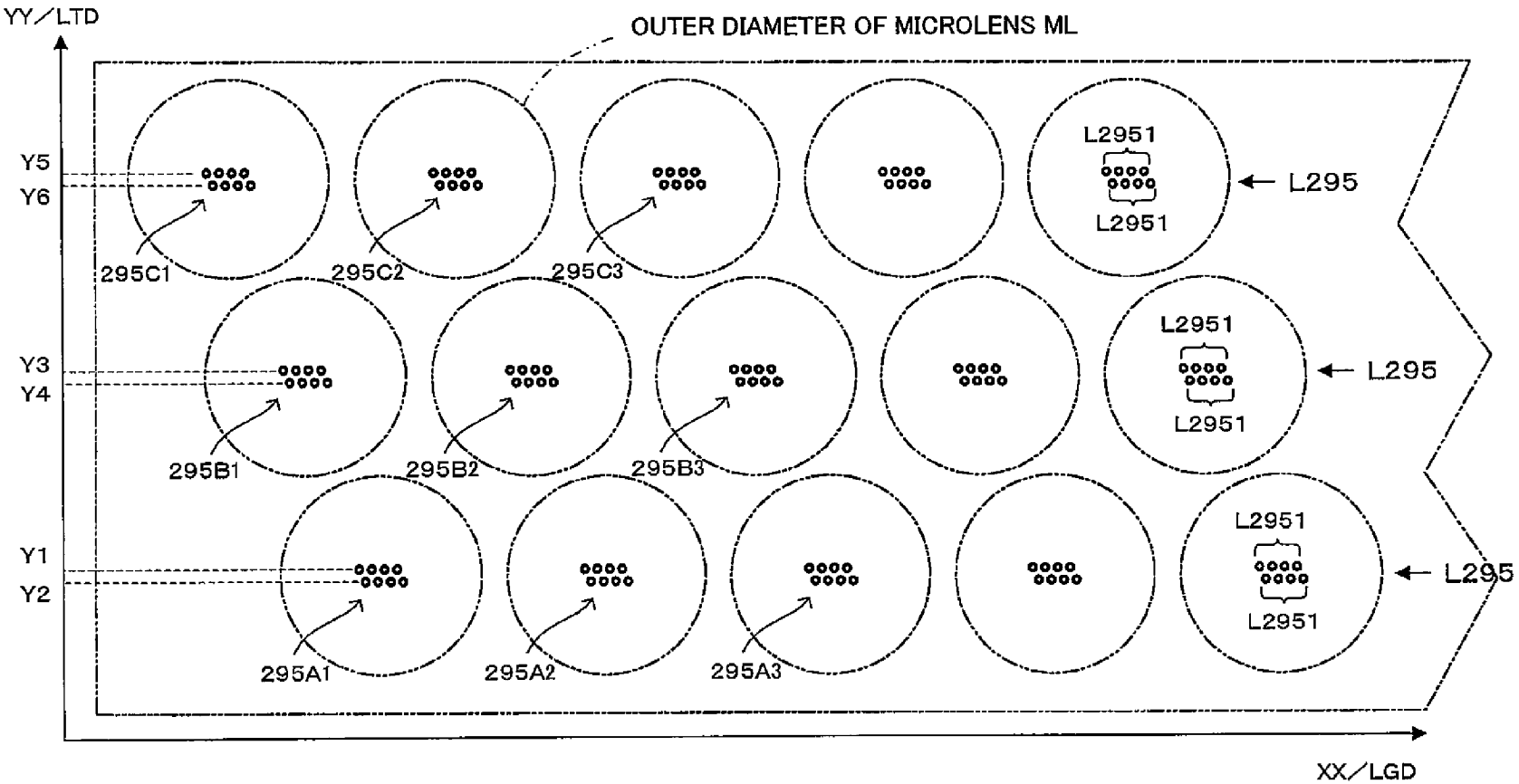
FIG. 22 is a diagram showing the arrangement of the plurality of the luminous element groups.

FIG. 22 is a diagram showing the arrangement of the plurality of the luminous element groups. In the fourth embodiment, one luminous element group 295 is constructed by arranging two luminous element lines L2951, each of which is formed by arranging four luminous elements 2951 at specified intervals in the longitudinal direction LGD which corresponds to the main scanning direction XX, in the width direction LTD which corresponds to the sub scanning direction YY. In other words, eight luminous elements 2951 corresponding to one circular microlens ML denoted at dashed-two dotted line in FIG. 22 constitute one luminous element group 295. And the plurality of luminous element groups 295 are arranged as follows.

Specifically, the luminous element groups 295 are two-dimensionally arranged such that three luminous element group lines (group line) L295, each of which is formed by arranging a specified number (more than one) of luminous element groups in the longitudinal direction LGD which corresponds to the main scanning direction XX, are arranged in the width direction LTD which corresponds to the sub scanning direction YY. All the luminous element groups 295 are arranged at mutually different main-scanning-direction positions. Further, the plurality of luminous element groups 295 are arranged such that the luminous element groups having adjacent main-scanning-direction positions (for example, luminous element group 295C1 and luminous element group 295B1) are located at different sub-scanning-direction positions. Meanwhile, in this specification, it is assumed that the position of each luminous element 2951 is the geometric center of gravity of the luminous element 2951. Hence, the distance between the two luminous elements is the distance between the two geometric centers of gravity of the respective luminous elements. Further, in this specification, "the geometric center of gravity of the luminous element group" means the geometric center of gravity of the positions of all the luminous elements 2951 belonging to the same luminous element group 295. Further, the main-scanning-direction position and the sub-scanning-direction position mean a main scanning direction component and a sub scanning direction component of a target position, respectively.

The light guiding holes 2971 are perforated in the light shielding part 297 and the lens pairs each comprised of the lenses 2993A and 2993B are arranged corresponding to the arrangement of the above luminous element groups 295. In other words, the center of gravity positions of the luminous element groups 295, the central axes of the light guiding holes 2971 and the optical axes OA of the lens pairs of the lenses 2993A and 2993B substantially coincide in this embodiment. The light beams emitted from the luminous elements 2951 of the luminous element groups 295 are incident on the microlens array 299 via the corresponding light guiding holes 2971 and imaged as spots on the surface of the photosensitive drum 21 by the microlens array 299.

Figure 23:
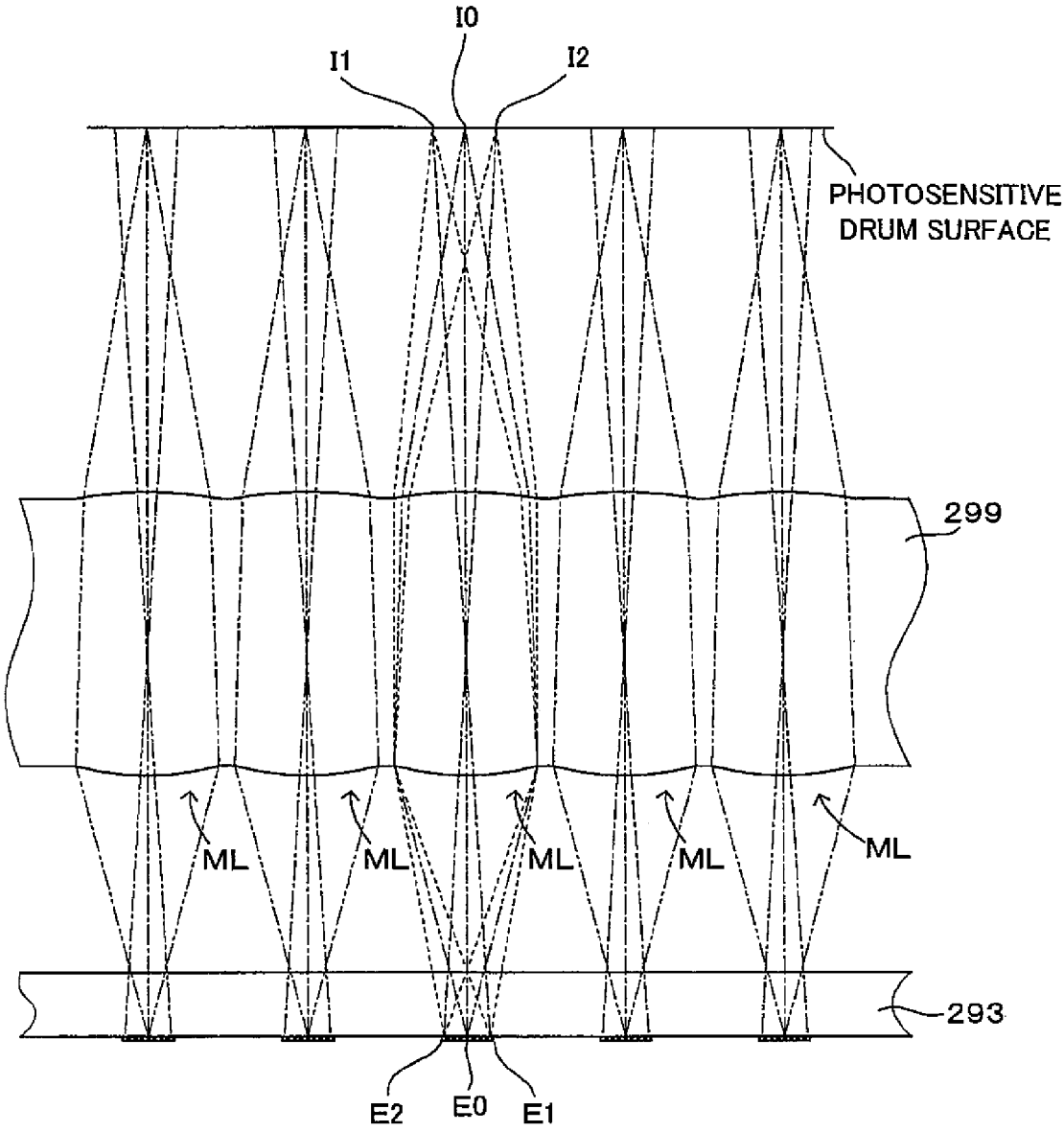
FIG. 23 is a diagram showing an imaging state of the microlens array according to the fourth embodiment.

FIG. 23 is a diagram showing an imaging state of the microlens array according to the fourth embodiment. In FIG. 23, trajectories of light beams emitted from the geometric center of gravity E0 of the luminous element group 295 and from the positions E1 and E2 which are separated by predetermined gaps from the geometric center of gravity E0 are shown in order to show the imaging property of the microlens array 299. As the trajectory shows, the light beam emitted from each position impinges upon the underside surface of the glass substrate 293 and thereafter leaves the top surface of the glass substrate 293. Leaving the top surface of the glass substrate 293, the light beam reaches the surface of the photosensitive drum (surface-to-be-scanned) via the microlens array 299.

As shown in FIG. 23, the light beam emitted from the geometric center of gravity E0 of the luminous element group is imaged on an intersection I0 of the surface of the photosensitive drum 21 and the optical axis OA of the lenses 2993A and 2993B. This results from the fact that the position of the geometric center of gravity E0 (the position of the luminous element group 295) of the luminous element group 295 lies on the optical axis OA of the lenses 2993A and 2993B in this embodiment as described above. The light beams emitted from the positions E1 and E2 are imaged at positions I1 and I2 on the surface of the photosensitive drum 21. Specifically, the light beam emitted from the position E1 is imaged at the position I1 at an opposite side of the optical axis OA of the lenses 2993A and 2993B with respect to the main scanning direction XX, and the light beam emitted from the position E2 is imaged at the position I2 at an opposite side of the optical axis OA of the lenses 2993A and 2993B with respect to the main scanning direction XX. In other words, the imaging lens constructed by the lens pair comprised of the lenses 2993A and 2993B having a common optical axis, and the glass substrate 2991 located between the lens pair is a so-called inverting optical system having an inverting property.

Further, as shown in FIG. 23, a distance between the positions I1 and I0 where the light beams are imaged is longer than a distance between the positions E1 and E0. That is to say that the absolute value of the magnification of the above optical system in the fourth embodiment is more than 1. In other words, the above optical system in the fourth embodiment is a so-called magnifying optical system having a magnifying property. In the fourth embodiment, the microlens ML which is an optical system constructed by the lens pair comprised of the lenses 2993A and 2993B having a common optical axis, and the glass substrate 2991 located between the lens pair thus functions as the "imaging lens" of the invention.

Figure 24:
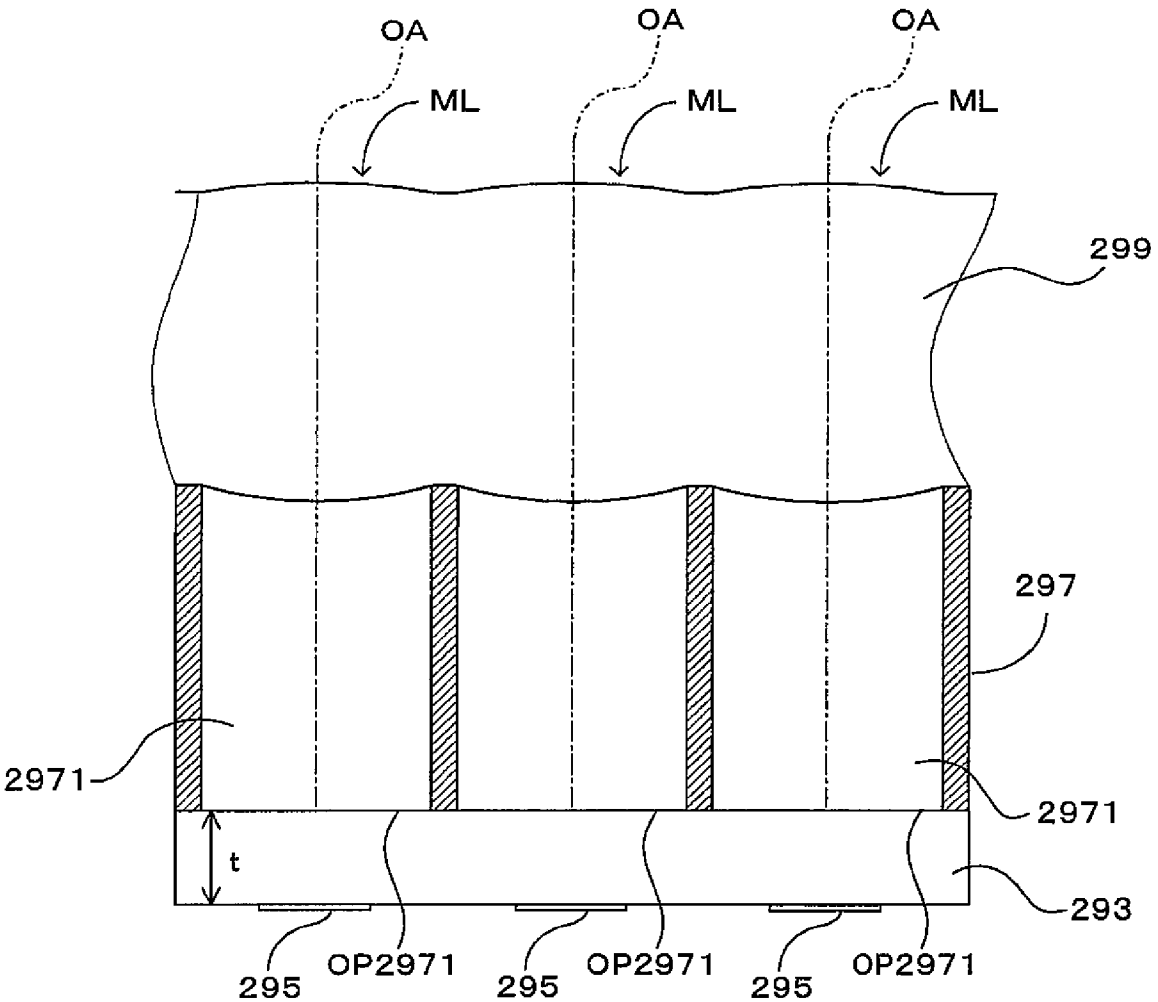
FIG. 24 is a diagram which shows a relationship among the luminous element groups, the light guiding holes and the microlenses.

FIG. 24 is a diagram which shows a relationship among the luminous element groups, the light guiding holes and the microlenses. As shown in FIG. 24, the plural luminous element groups 295 are provided spaced apart from each other on the underside surface of the glass substrate (transparent substrate) 293 whose thickness is t and index of refraction is n. The plural microlenses (imaging lenses) ML are arranged in the one-to-one correspondence to the luminous element groups 295. Meanwhile, the light shielding part 297 is disposed so that its one surface is opposed to the top surface of the glass substrate and its other surface is opposed to the plural imaging lenses. The plural light guiding holes 2971 are perforated in the light shielding part 297 in such a manner that each light guiding hole 2971 corresponds to each luminous element group 295 and penetrates the light shielding part 297 from one surface to the other surface of the light shielding part 297. Each of the plural light guiding holes 2971 is provided symmetrically with respect to the optical axis OA of the corresponding microlens ML.

As shown in FIG. 24, the line head in this embodiment comprises the light shielding part 297 which includes the plural light guiding holes 2971 which are perforated such that they correspond to the plural microlenses ML on the one-to-one correspondence. Hence, light beams emitted from the luminous element groups 295 via the glass substrate (transparent substrate) 293 are guided by the light guiding holes 2971 of the light shielding part 297 to the opposed microlenses (imaging lenses) ML. That is, light beams which can impinge upon the microlenses ML are only those light beams which have passed through apertures OP2971 in one surfaces of the light guiding holes 2971 which correspond to these microlenses ML.

Figure 25:
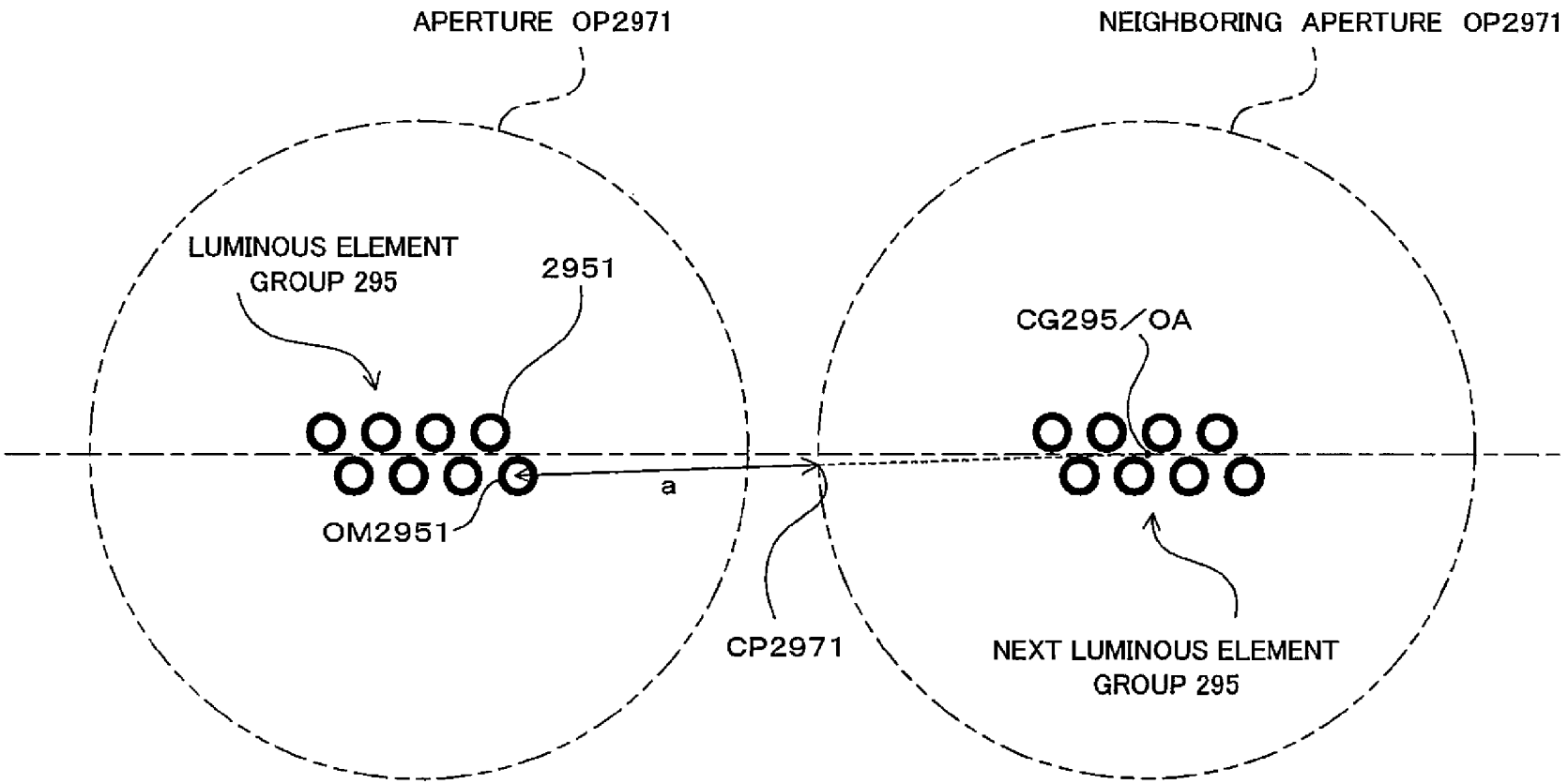
FIG. 25 is a diagram which shows a relationship between the luminous element groups and the apertures.

FIG. 25 is a diagram which shows a relationship between the luminous element groups and the apertures. As described above, in the fourth embodiment, each of the plural light guiding holes 2971 is perforated symmetrically with respect to the optical axis OA of the corresponding microlens ML. Further, in the fourth embodiment, as shown in FIG. 25, for each one of the plural luminous element groups 295, the plural luminous elements 2951 belonging to the luminous element group 295 are arranged symmetrically with respect to the optical axis OA of the corresponding microlens ML (namely, the central axis of the aperture OP2971 of the light guiding hole). The geometric center of gravity CG295 of the luminous element group 295 therefore coincides with the optical axis OA of the microlens ML.

Each one of the plural luminous element groups has the following structure in the line head according to the fourth embodiment. To be more specific, in the fourth embodiment, of the plural luminous elements 2951 belonging to each luminous element group 295, the one which is at the shortest distance to the neighboring aperture OP2971 which is in one surface of the light guiding hole 2971 which corresponds to the next luminous element group 295 which is next to each luminous element group 295 is defined as the outer-most element OM2951. The one surface herein referred to is one of the surfaces of the light shielding part 297 which is opposed to the glass substrate 293. The thickness t and the index of refraction n of the glass substrate 293 are set so that a light beam emitted from the outer-most element OM2951 toward the neighboring aperture OP2971 is totally reflected by the top surface of the glass substrate 293 inside the neighboring aperture OP2971. Specifically, the line head is structured so as to satisfy the following formula:

$$1+t^2/a^2<n^2$$

where the symbol a denotes a distance between the outer-most element OM2951 and the neighboring aperture within a parallel plane to the top surface of the glass substrate 293 (that is, within a parallel plane to the plane of FIG. 25).

Figure 26:
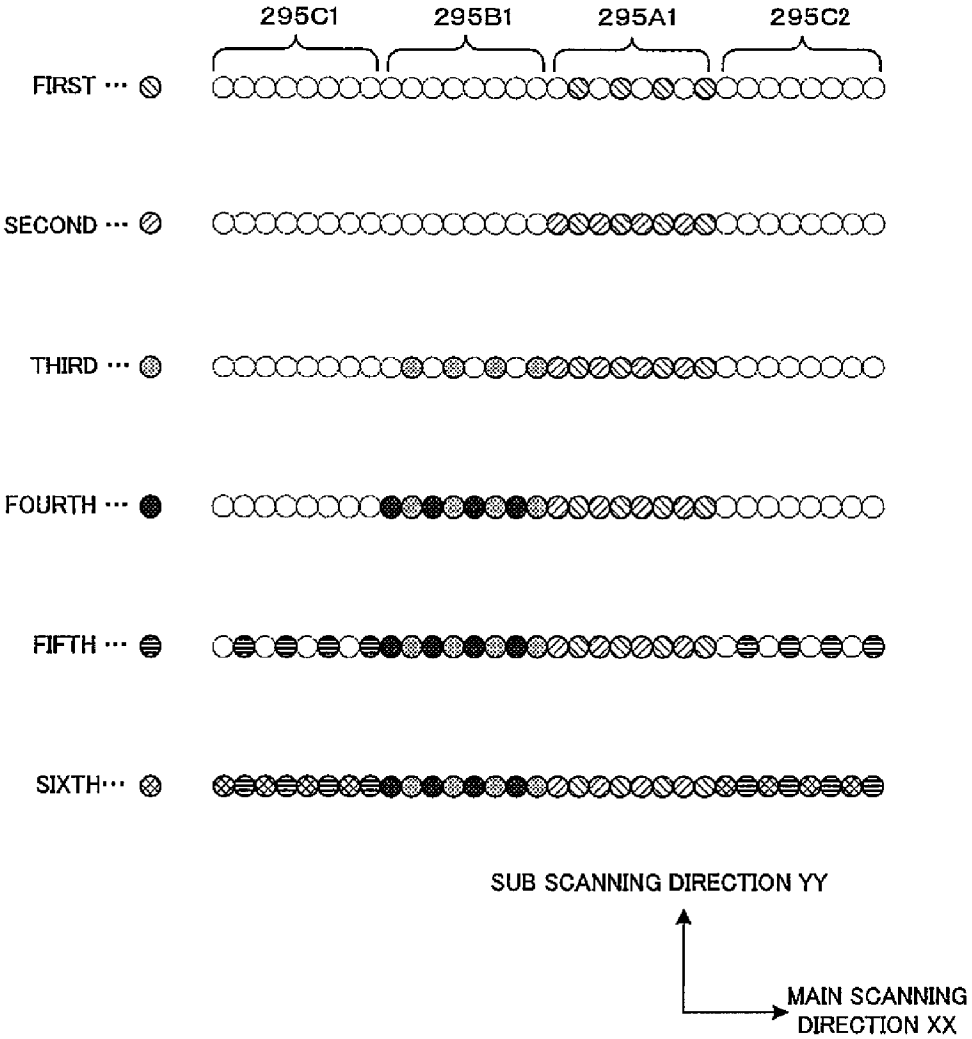
FIG. 26 is a diagram showing the spot forming operation by the above line head.

FIG. 26 is a diagram showing the spot forming operation by the above line head. The spot forming operation by the line head according to this embodiment is described below with reference to FIGS. 2, 22 and 26. In order to make the invention easily understandable, here is described the case where a plurality of spots are formed side by side on a straight line extending in the main scanning direction XX. In this embodiment, a plurality of spots are formed side by side on a straight line extending in the main scanning direction XX by causing a plurality of luminous elements to emit light beams at specified timings by the head control module 54 while the surface (surface-to-be-scanned) of the photosensitive drum (latent image carrier) 21 is conveyed in the sub scanning direction YY.

Specifically, in the line head of this embodiment, six luminous element lines L2951 are arranged in the sub scanning direction YY corresponding to sub-scanning-direction positions Y1 to Y6 (FIG. 22). Accordingly, in this embodiment, the luminous element lines L2951 at the same sub-scanning-direction position are caused to emit light beams substantially at the same timing and the luminous element lines L2951 at different sub-scanning-direction positions are caused to emit light beams at different timings from each other. More specifically, the luminous element lines L2951 are caused to emit light beams in the order of the sub-scanning-direction positions Y1 to Y6. By causing the luminous element lines L2951 to emit light beams in the above order while conveying the surface of the photosensitive drum 21 in the sub scanning direction YY, a plurality of spots are formed side by side on a straight line extending in the main scanning direction XX on the above surface.

Such an operation is described with reference to FIGS. 22 and 26. First of all, the luminous elements 2951 of the luminous element lines L2951 at the sub-scanning-direction position Y1 belonging to the luminous element groups 295A1, 295A2, 295A3, . . . which are located most upstream in the sub scanning direction YY are caused to emit light beams. A plurality of light beams emitted by such a light emitting operation are imaged on the photosensitive drum surface while being inverted and magnified by the "imaging lens" having the above inverting and magnifying property. In other words, spots are formed at hatched positions of the "first" light emitting operation of FIG. 26. In FIG. 26, outline circles represent spots not formed yet, but planned to be formed later. Further, in FIG. 26, spots labeled with reference characters 295C1, 295B1, 295A1 and 295C2 are those to be formed by the luminous element groups 295 corresponding to the respectively assigned reference characters.

Subsequently, the luminous elements 2951 of the luminous element lines L2951 at the sub-scanning-direction position Y2 belonging to the same luminous element groups 295A1, 295A2, 295A3, . . . are caused to emit light beams. A plurality of light beams emitted by such a light emitting operation are imaged on the photosensitive drum surface while being inverted and magnified by the "imaging lens" having the above inverting and magnifying property. In other words, spots are formed at hatched positions of the "second" light emitting operation of FIG. 26. Here, in order to cope with the inverting property of the "imaging lens", the surface of the photosensitive drum 21 is conveyed in the sub scanning direction YY while the luminous element lines L2951 are caused to emit light beams from the downstream side with respect to the sub scanning direction YY (that is, in the order of the sub-scanning-direction positions Y1 and Y2).

Next, the luminous elements 2951 of the luminous element lines L2951 at the sub-scanning-direction position Y3 belonging to the luminous element groups 295B1, 295B2, 295B3, . . . , which are second from the upstream side in the sub scanning direction YY, are caused to emit light beams. A plurality of light beams emitted by such a light emitting operation are imaged on the photosensitive drum surface while being inverted and magnified by the "imaging lens" having the above inverting and magnifying property. In other words, spots are formed at hatched positions of the "third" light emitting operation of FIG. 26.

Subsequently, the luminous elements 2951 of the luminous element lines L2951 at the sub-scanning-direction position Y4 belonging to the same luminous element groups 295B1, 295B2, 295B3, . . . are caused to emit light beams. A plurality of light beams emitted by such a light emitting operation are imaged on the photosensitive drum surface while being inverted and magnified by the "imaging lens" having the above inverting and magnifying property. In other words, spots are formed at hatched positions of the "fourth" light emitting operation of FIG. 26.

Subsequently, the luminous elements 2951 of the luminous element lines L2951 at the sub-scanning-direction position Y5 belonging to the luminous element groups 295C1, 295C2, 295C3, . . . are caused to emit light beams. A plurality of light beams emitted by such a light emitting operation are imaged on the photosensitive drum surface while being inverted and magnified by the "imaging lens" having the above inverting and magnifying property. In other words, spots are formed at hatched positions of the "fifth" light emitting operation of FIG. 26.

Finally, the luminous elements 2951 of the luminous element lines L2951 at the sub-scanning-direction position Y6 belonging to the same luminous element groups 295C1, 295C2, 295C3, . . . are caused to emit light beams. A plurality of light beams emitted by such a light emitting operation are imaged on the photosensitive drum surface while being inverted and magnified by the "imaging lens" having the above inverting and magnifying property. In other words, spots are formed at hatched positions of the "sixth" light emitting operation of FIG. 26. In this way, a plurality of spots are formed side by side on the straight line extending in the main scanning direction XX by performing the first to sixth light emitting operations.

As described above, in the line head 29 according to the fourth embodiment, the plural luminous element groups 295, each including the plural luminous elements 2951, are arranged spaced apart from each other on the back surface of the glass substrate (transparent substrate) 293. The plural microlenses (imaging lenses) ML are disposed for the luminous element groups 295 on the one-to-one correspondence. The plural microlenses ML image light beams emitted from the plural luminous elements 2951 belonging to the corresponding luminous element groups 295 via the glass substrate (transparent substrate) 293 and form spots on the photosensitive drum surface (surface-to-be-scanned). This may give rise to a problem of crosstalk that light beams emitted from the luminous elements 2951 belonging to a certain luminous element group 295 impinge also upon the microlens ML which corresponds to the next luminous element group 295 to this luminous element group 295.

The line head 29 described above has the following structure to deal with this problem of crosstalk. To be more specific, the line head 29 described above comprises the light shielding part 297 which is disposed so that its one surface is opposed to the top surface of the glass substrate (transparent substrate) 293 and its other surface is opposed to the plural microlenses (imaging lenses) ML. The light shielding part 297 further comprises the plural light guiding holes 2971 which correspond to the plural luminous element groups 295 on the one-to-one correspondence and penetrate the light shielding part 297 from one surface to the other surface of the light shielding part 297. Hence, light beams emitted from the luminous element groups 295 via the glass substrate 293 are guided to the corresponding microlenses ML by the light guiding holes 2971 which are perforated in the light shielding part 297. In short, light beams which can impinge upon the microlenses ML are only those light beams which have passed through apertures OP2971 which are in one surfaces of the light guiding holes 2971 which correspond to these microlenses ML. The line head 29 according to the invention, using the structure below, restricts light beams from one luminous element group 295 which is next to the luminous element group 295 corresponding to the aperture OP2971 which is in one surface of the light guiding hole 2971 from passing through this aperture OP2971.

In the fourth embodiment, of the plural luminous elements 2951 belonging to each luminous element group 295, the luminous elements 2951 which is at the shortest distance to the neighboring aperture OP2971 which is in one surface of the light guiding hole 2971 which corresponds to the next luminous element group 295 which is next to this luminous element group 295 is defined as the outer-most element OM2951. The one surface herein referred to is one of the surfaces of the light shielding part 297 which is opposed to the glass substrate 293. The thickness t and the index of refraction n of the glass substrate 293 are set so that a light beam emitted from the outer-most element OM2951 toward the neighboring aperture OP2971 is totally reflected by the top surface of the glass substrate 293 inside the neighboring aperture OP2971 (that is, so that a total reflection condition is met). Therefore, in this embodiment, for satisfaction of the total reflection condition, the line head 29 is structured in such a manner that the following formula is satisfied:

$$1+t^2/a^2<n^2 \qquad \text{Formula 4}$$

where the symbol a denotes a distance between the outer-most element OM2951 and the neighboring aperture within a parallel plane to the top surface of the glass substrate 293. Hence, when light beams emitted from the luminous elements 2951 belonging to a certain luminous element group 295 impinge upon the neighboring aperture OP2971 corresponding to the next luminous element group 295 to this luminous element group 295, the top surface of the glass substrate (transparent substrate) 293 within the neighboring aperture OP2971 totally reflects the light beams. The reason why satisfaction of the inequality above makes it possible to satisfy the total reflection condition will now be described.

Figure 27:
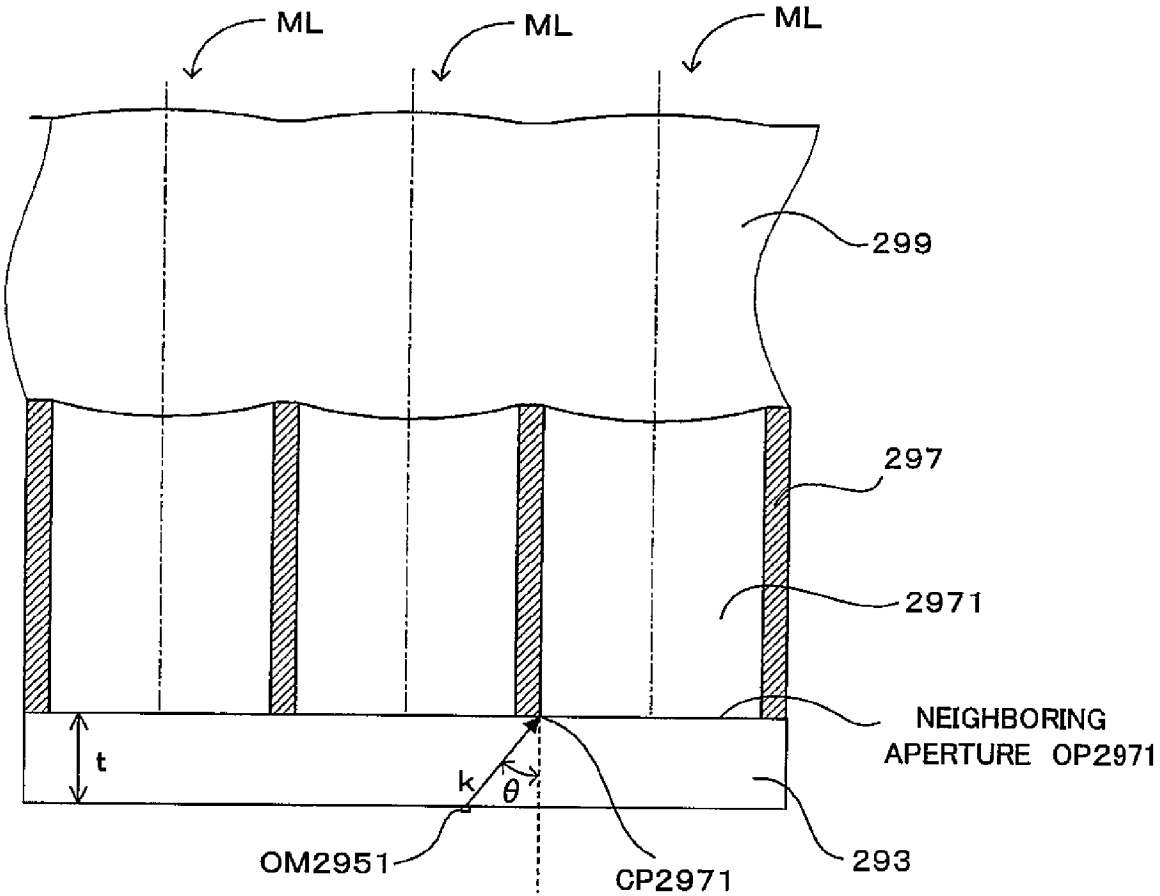
FIG. 27 is a diagram which shows the justification of the inequality denoted as Formula 4.

FIG. 27 is a diagram which shows the justification of the inequality denoted as Formula 4. For identification of a condition to suppress crosstalk described above, such a condition may be identified which makes the top surface of the glass substrate 293 within the neighboring aperture OP2971 totally reflect all light beams emitted from the plural luminous elements 2951 belonging to the luminous element group 295, that is, a condition which makes the top surface of the glass substrate 293 within the neighboring aperture OP2971 totally reflect the light beam (denoted at the arrow in FIG. 27) emitted from the outer-most element OM2951 which is at the shortest distance to the neighboring aperture OP2971 among the plural luminous elements 2951 belonging to the luminous element group 295. Since the index of refraction of the glass substrate 293 is n, the following inequality needs be satisfied in order to meet this condition:

$$n\times\sin\theta>1$$

where the symbol θ denotes an angle between a line extending from the outer-most element OM2951 toward a point CP2971 which is nearest to the outer-most element OM2951 in the neighboring aperture OP2971 and the normal line to the top surface of the glass substrate 293. Hence, rewriting this inequality using a distance k between the point CP2971 and the outer-most element OM2951, the following relationship is obtained:

$$a/k>1/n$$

Squaring the both sides and calculating the inverse numbers of the both sides, the following relationship is obtained:

$$k^2/a^2<n^2$$

Further, since $k^2=t^2+a^2$, the relationship below is finally obtained:

$$1+t^2/a^2<n^2$$

When the inequality denoted as Formula 4 is satisfied therefore, the top surface of the glass substrate (transparent substrate) 293 within the neighboring aperture OP2971 totally reflects light beams emitted from the luminous elements 2951 belonging to a certain luminous element group 295 and incident upon the neighboring aperture OP2971 corresponding to the next luminous element group 295 to this luminous element group 295.

That is, the line head 29 according to the fourth embodiment suppresses transmission of light beams emitted from the luminous elements 2951 belonging to a certain luminous element group 295 through the neighboring aperture OP2971 which corresponds to this luminous element group 295. This discourages crosstalk that light beams emitted from the luminous elements 2951 belonging to a certain luminous element group 295 also impinge upon the microlens (imaging lens) ML which corresponds to the next luminous element group 295 to this luminous element group 295, and realizes favorable spot formation.

Further, in the fourth embodiment, the light guiding holes 2971 are formed symmetrically with respect to the optical axes OA of the microlenses (imaging lenses) ML and the plural luminous elements 2951 belonging to the luminous element groups 295 are arranged symmetrically with respect to the optical axes OA. The symmetric arrangement maximizes the distance a, which works to an advantage in satisfying the inequality denoted as Formula 4. This more efficiently suppress crosstalk and easily achieves favorable spot formation, which is preferable.

Further, the image forming apparatus according to the fourth embodiment comprises the line head above as the exposure section. The exposure section forms spots on the photosensitive drum surface (latent image carrier surface). This restricts transmission of light beams from the luminous elements 2951 belonging to a certain luminous element group 295 through the neighboring aperture OP2971 which corresponds to this luminous element group 295. This discourages crosstalk that light beams emitted from the luminous elements 2951 belonging to a certain luminous element group 295 impinge also upon the microlens (imaging lens) ML which corresponds to the next luminous element group 295 to this luminous element group 295, which in turn makes it possible to form an image with favorable spots.

In essence, in the line head according to the fourth embodiment and in the image forming apparatus which uses this line head, the plural luminous element groups each including the plural luminous elements are arranged spaced apart from each other on the back surface of the transparent substrate. The plural imaging lenses are disposed for the plural luminous element groups on the one-to-one correspondence. And the plural imaging lenses image, on the surface-to-be-scanned, light beams emitted from the plural luminous elements belonging to the corresponding luminous element group via the glass substrate, thereby forming spots. This may give rise to a problem of crosstalk that light beams emitted from the luminous elements belonging to a certain luminous element group impinge also upon the imaging lens which corresponds to the next luminous element group to this luminous element group.

The line head according to the fourth embodiment has the following structure to deal with this problem of crosstalk. To be more specific, the line head according to the invention comprises the light shielding part which is disposed so that its one surface is opposed to the top surface of the transparent substrate and its other surface is opposed to the plural imaging lenses. Further, the light shielding part comprises the plural light guiding holes which correspond to the plural luminous element groups on the one-to-one correspondence and penetrate the light shielding part from one surface to the other surface of the light shielding part. Hence, light beams emitted from the luminous element groups via the glass substrate are guided to the corresponding imaging lenses by the light guiding holes which are perforated in the light shielding part. In short, light beams which can impinge upon the imaging lenses are only those light beams which have passed through apertures which are in one surfaces of the light guiding holes which correspond to these imaging lenses. The line head according to the invention, using the structure below, restricts light beams from one luminous element group which is next to the luminous element group corresponding to the aperture which is in one surface of the light guiding hole from passing through this aperture.

That is, in the line head according to the fourth embodiment, the thickness and the index of refraction of the transparent substrate are set so that as for each one of the plurality of luminous element groups, the top surface of the transparent substrate within the neighboring aperture, which is in one surface of the light guiding hole which corresponds to the next luminous element group which is next to this luminous element group, totally reflects a light beam emitted toward the neighboring aperture from the outer-most element among the luminous elements belonging to this luminous element group which is at the shortest distance to the neighboring aperture.

In the line head having the structure described above, when light beams emitted from the luminous elements belonging to a certain luminous element group impinge upon the neighboring aperture which corresponds to the next luminous element group to this luminous element group, the top surface of the transparent substrate totally reflects the light beams inside the neighboring aperture. This suppresses passage of the light beams emitted from the luminous elements belonging to the certain luminous element group through the neighboring aperture which corresponds to the next luminous element group to this luminous element group. It is therefore possible to suppress crosstalk that the light beams emitted from the luminous elements belonging to the certain luminous element group impinge also upon the imaging lens which corresponds to the next luminous element group to this luminous element group, and to form favorable spots.

Further, as described in relation to the fourth embodiment, assuming that the thickness of the transparent substrate is t and the index of refraction of the transparent substrate is n, the line head may have the following structure. To be more specific, as for each one of the plural luminous element groups, the following relationship may be satisfied:

$$1+t^2/a^2<n^2$$

where the symbol a denotes a distance between the outermost element and the neighboring aperture within a parallel plane to the top surface of the transparent substrate.

Use of this structure restricts light beams emitted from the luminous elements belonging to a certain luminous element group from passing through the neighboring aperture which corresponds to the next luminous element group to this luminous element group. It is therefore possible to suppress crosstalk that the light beams emitted from the luminous elements belonging to the certain luminous element group impinge also upon the imaging lens which corresponds to the next luminous element group to this luminous element group, and to form favorable spots.

Further, the light guiding holes may be provided symmetrically with respect to the optical axes of the imaging lenses and the plural luminous elements belonging to the luminous element groups may be arranged symmetrically with respect to the optical axes. This is because the symmetric arrangement maximizes the distance a, which works to an advantage in satisfying the inequality above.

By the way, for satisfaction of the total reflection condition, the fourth embodiment requires satisfying the inequality denoted as Formula 4. However, in the event that the index of refraction of the transparent substrate is not uniform for instance, an inequality to satisfy the total reflection condition may be identified considering such a distribution of the index of refraction and the line head may be structured so as to satisfy thus obtained inequality to thereby enjoy the effect of prevented crosstalk, which is needless to mention.

Further, although the light guiding holes 2971 are formed symmetrically with respect to the optical axes OA of the microlenses (imaging lenses) ML and the plural luminous elements 2951 belonging to the luminous element groups 295 are arranged symmetrically with respect to the optical axes OA in the fourth embodiment, this arrangement is not an essential requirement. Nevertheless, this arrangement is preferable in that the distance a is maximized, which works to an advantage in satisfying the inequality denoted as Formula 4, and that, as a result, favorable spot formation is easily realized.

Thus, in the above embodiment, the top surface of the transparent substrate corresponds to the "first surface" of the invention, and the back surface of the transparent substrate corresponds to the "second surface" of the invention.

It should be noted that the invention is not limited to the embodiment above, but may be modified in various manners in addition to the embodiment above, to the extent not deviating from the object of the invention.

For instance, in the embodiments above, although the transparent substrate is made of glass, the material of the transparent substrate is not limited to glass of course. In other words, the transparent substrate may be made of a material which is capable of transmitting a light beam.

Further, the plural luminous element groups are arranged in the embodiments above as shown in FIG. 7, 22 or the like. That is, one luminous element group 295 is constructed by arranging two luminous element lines L2951, each of which is formed by arranging four luminous elements 2951 at specified intervals in the main scanning direction XX, in the sub scanning direction YY. However, the number of the luminous elements 2951 forming one luminous element group 295, the arrangement of the plural luminous elements 2951 and the like are not limited to these but may be appropriately modified. However, with respect to the arrangement of the plural luminous elements 2951, the symmetric arrangement above is preferable in that it easily attains favorable spot formation as described above.

Further, in the embodiments above, the luminous element groups 295 are two-dimensionally arranged such that three luminous element group lines (group line) L295, each of which is formed by arranging a specified number (more than one) of luminous element groups in the main scanning direction XX, are arranged in the sub scanning direction YY. However, the arrangement of the plural luminous element groups 295 is not limited to this but may be appropriately modified.

Further, although the embodiments above use magnifying optical systems as the imaging lenses, this is not indispensable for the invention. That is, reducing optical systems whose magnification (optical magnification) is below 1, equal-magnification optical systems whose magnification is approximately 1 or the like may be used as the imaging lenses.

Further, in the above embodiment, a plurality of spots are formed side by side along the straight line in the main scanning direction XX as shown in FIG. 26 by means of the line head according to the invention. However, such a spot forming operation is an example of the operation of the line head according to the invention, and an operation executable by this line head is not limited to this. Specifically, it is not necessary to form spots side by side along a straight line in the main scanning direction XX. For example, spots may be formed side by side along a line at a specified angle to the main scanning direction XX or along a zigzag line or a wavy line.

Although the invention is applied to the color image forming apparatus in the above embodiment, the application thereof is not limited to this and the invention is also applicable to monochromatic image forming apparatuses which form monochromatic images.

Although the invention has been described with reference to specific embodiments, this description is not meant to be construed in a limiting sense. Various modifications of the disclosed embodiment, as well as other embodiments of the invention, will become apparent to persons skilled in the art upon reference to the description of the invention. It is therefore contemplated that the appended claims will cover any such modifications or embodiments as fall within the true scope of the invention.

What is claimed is:

1. A line head, comprising:

a substrate which transmits a light beam;

a luminous element group which includes a plurality of luminous elements which are on the substrate;

an imaging lens which is provided corresponding to the luminous element group; and a light shielding member which is disposed so that its one surface is opposed to a surface of the substrate, the surface being different from the surface on which the luminous element group is provided, and that its other surface is opposed to the imaging lens, and which includes a light guiding hole corresponding to the luminous element group, wherein a thickness of the substrate and an index of refraction of the substrate are set so that a light beam emitted from an outer-most element, which is a luminous element which is one of the luminous elements belonging to the luminous element group and which is located at the shortest distance to a neighboring aperture in the one surface of the light guiding hole which corresponds to a next luminous element group which is next to the luminous element group, toward the neighboring aperture is totally reflected by the surface, which is opposed to the light shielding member, of the substrate.

2. The line head of claim 1, wherein the formula:

$$1+t^2/a^2<n^2$$

is satisfied, where t is the thickness of the substrate, n is the index of refraction of the substrate, and a is a distance between the outer-most element and the neighboring aperture within a parallel plane to the surface, which is opposed to the light shielding member, of the substrate.

3. The line head of claim 2, wherein the light guiding hole which corresponds to the luminous element group is provided symmetrically with respect to an optical axis of the imaging lens which corresponds to the luminous element group, and the plurality of luminous elements which belong to the luminous element group are arranged symmetrically with respect to the optical axis.

* * * * *